US007014436B2

(12) United States Patent
Klassen

(10) Patent No.: US 7,014,436 B2
(45) Date of Patent: Mar. 21, 2006

(54) GEAR PUMP

(75) Inventor: James B. Klassen, Lynden, WA (US)

(73) Assignee: M&M Technologies, Inc., Lynden, WA (US)

( * ) Notice: Subject to any disclaimer, the term of this patent is extended or adjusted under 35 U.S.C. 154(b) by 0 days.

(21) Appl. No.: 10/452,827

(22) Filed: Jun. 2, 2003

(65) Prior Publication Data

US 2005/0276714 A1 Dec. 15, 2005

Related U.S. Application Data

(60) Provisional application No. 60/385,689, filed on Jun. 3, 2002, provisional application No. 60/464,395, filed on Apr. 18, 2003.

(51) Int. Cl.
*F04C 2/00* (2006.01)

(52) U.S. Cl. ..... 418/170; 418/180; 418/206.5

(58) Field of Classification Search ..... 418/170, 418/189, 206.1, 206.5
See application file for complete search history.

(56) References Cited

U.S. PATENT DOCUMENTS 295,597 A * 3/1884 Troutman ..... 418/206.5
1,129,090 A * 2/1915 Hawley ..... 418/189
3,113,524 A * 12/1963 Fulton ..... 418/206.5
3,303,792 A * 2/1967 Littlewood ..... 418/189
4,130,383 A * 12/1978 Moinuddin ..... 418/189
4,548,562 A * 10/1985 Hughson ..... 418/189
5,114,325 A * 5/1992 Morita ..... 418/171
5,145,349 A * 9/1992 McBurnett ..... 418/206.5
6,206,666 B1 * 3/2001 Steinrock et al. ..... 418/206.1
6,312,241 B1 * 11/2001 Kamamoto et al. ..... 418/189

FOREIGN PATENT DOCUMENTS

JP 60-150492 * 8/1985 ..... 418/206.5
JP 2-286889 * 11/1990 ..... 418/206.5
JP 6-272672 * 9/1994 ..... 418/170
JP 6-272673 * 9/1994 ..... 418/170

* cited by examiner

*Primary Examiner*—Theresa Trieu
(74) *Attorney, Agent, or Firm*—Morland C. Fischer

(57) ABSTRACT

A pump comprises a driving rotor and a driven rotor that are positioned in a housing such that, as the driving rotor and the driven rotor rotate, the teeth of the driving rotor and the teeth of the driven rotor mesh to form a positive displacement seal. The teeth of the driving rotor and the driven rotor are configured such that seals between the inlet side and the discharge side of the pump are formed between only the leading surfaces of the teeth of the driving rotor and the trailing surfaces of the teeth of the driven rotor.

35 Claims, 49 Drawing Sheets

GEAR PUMP

PRIORITY INFORMATION

This application claims priority under 35 U.S.C. § 119(e) of Provisional Application 60/385,689, filed Jun. 3, 2002 and Provisional Application 60/464,395 filed Apr. 18, 2003, the entirety of these applications are herein incorporated by reference.

BACKGROUND OF THE INVENTION

1. Field of the Invention

The present invention relates to pumps, and, in particular, to gear pumps.

2. Description of the Related Art

FIG. 1 is a schematic illustration of an exemplary prior art gear pump 100. Such a pump 100 typically includes a casing 111 and a pair of rotors 113, 115, with intermeshing gear teeth 117. The casing 111 defines an inlet port 107 and an outlet port 108, which extend in a generally radial direction with respect to the rotors 113, 115. Fluid is carried from the inlet port 108 in spaces (or chambers) 102 that are formed between the gear teeth of the rotors. The fluid in these chambers 102 is displaced as the teeth engage with the teeth of the opposing rotor and the fluid is displaced out the discharge port 108.

Such conventional gear pumps are simple and relatively inexpensive, but suffer from a number of performance limitations. A source of problems with conventional gear pumps is in the area where the teeth 117 mesh and create a seal 104 between the inlet and discharge ports 107, 108. Conventional gear pumps use conventional gear tooth profiles such as would be used in a geared power transmission device. This type of gear configuration is well suited for power transmission, but has significant limitations when used to pump incompressible fluid.

A need therefore exists for an improved gear pump which addresses at least some of the problems described above.

SUMMARY OF THE INVENTION

In one embodiment having certain features and advantages according to the present invention, a gear pump is configured to address the tendency of conventional gear pumps to show significant reductions in performance as the teeth experience wear. In such an embodiment, the gear pump may utilize a modified gear tooth profile and a corresponding inlet and discharge port design to provide a number of performance characteristics including reduced turbulence, reduced vibration, and reduced noise, while providing a pump with the ability to experience significant wear between the gear teeth with minimal effect on volumetric efficiency and pressure capability.

Another aspect of the present inventions comprises a pump having a driving rotor and a driven rotor that are positioned in a housing such that, as the driving rotor and the driven rotor rotate, the teeth of the driving rotor and the teeth of the driven rotor mesh to form a positive displacement chamber. The teeth of the driving rotor and the driven rotor are configured such a seal between the inlet side and the discharge side of the pump is formed between only the leading surfaces the driving rotor and the trailing surfaces of the driven rotor.

Another aspect of the present inventions comprises a pump having a driving rotor and a driven rotor that are positioned in a housing such that, as the driving rotor and the driven rotor rotate, the teeth of the driving rotor and the teeth of the driven rotor mesh with sufficient backlash to form a seal between the inlet side and the discharge side of the pump, which is formed only between the leading surfaces the driving rotor and the trailing surfaces of the driven rotor.

DETAILED DESCRIPTION OF THE PREFERRED EMBODIMENT

FIGS. 2–5 illustrate an exemplary embodiment of an internal gear pump 200 having certain features and advantages according to the present invention. The term "pump" is used broadly, and includes its ordinary meaning, and further includes a device which displaces fluid or which turns as the result of the displacement of fluid, either compressible or incompressible. As such, the term "pump" is intended to include such applications as hydraulic motors or other devices which require expanding chambers or compressing chambers or both. In addition, throughout this description reference is made to certain directions (e.g., forward, backward, up, down, etc.) and relative positions (e.g., top, bottom, lower, upper, side, etc.). However, it should be appreciated that such directions and relative positions are intended merely to help the reader and are not intended to limit the invention.

Figure 1:
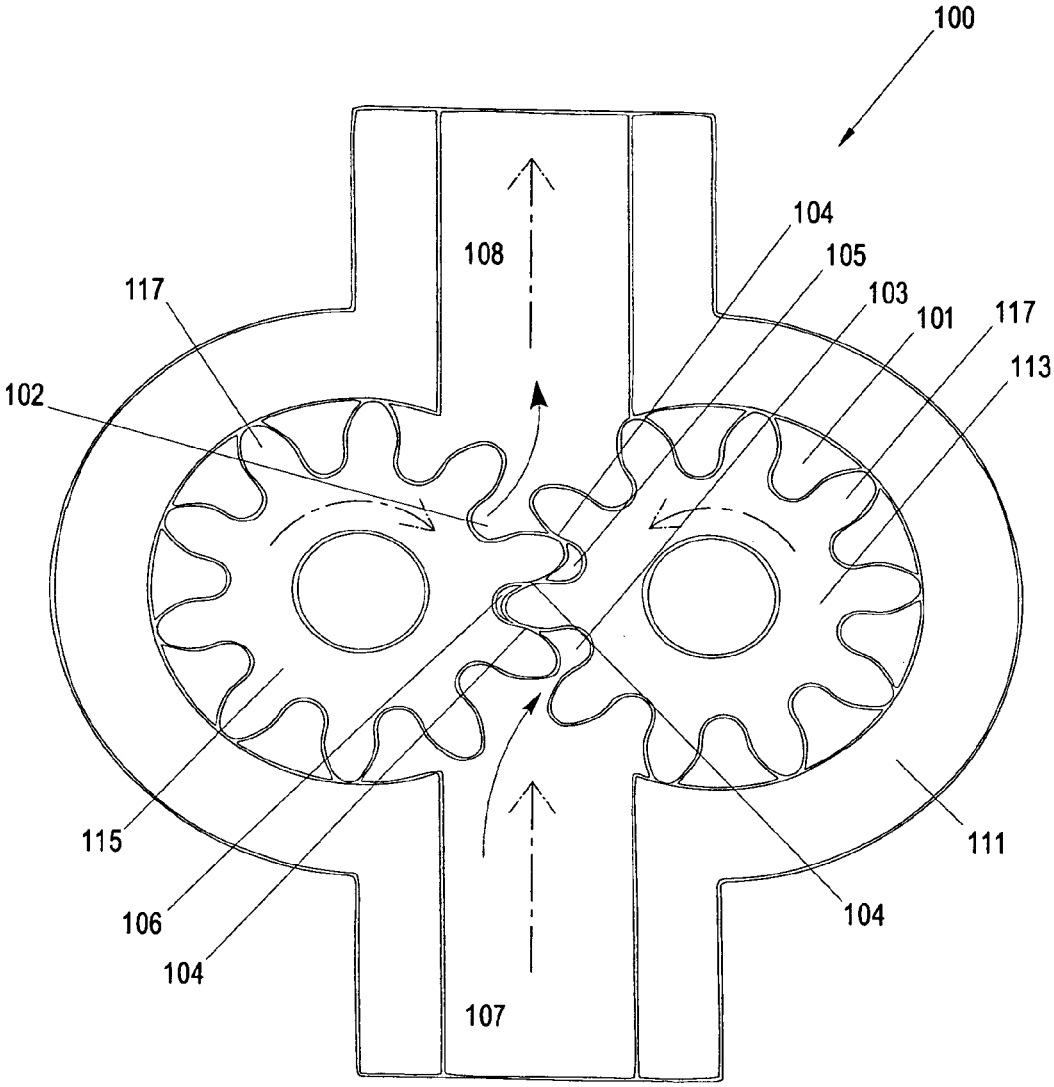
FIG. 1 PRIOR ART
FIG. 1 is a schematic illustration of a top plan view of a prior art pump.
Figure 2:
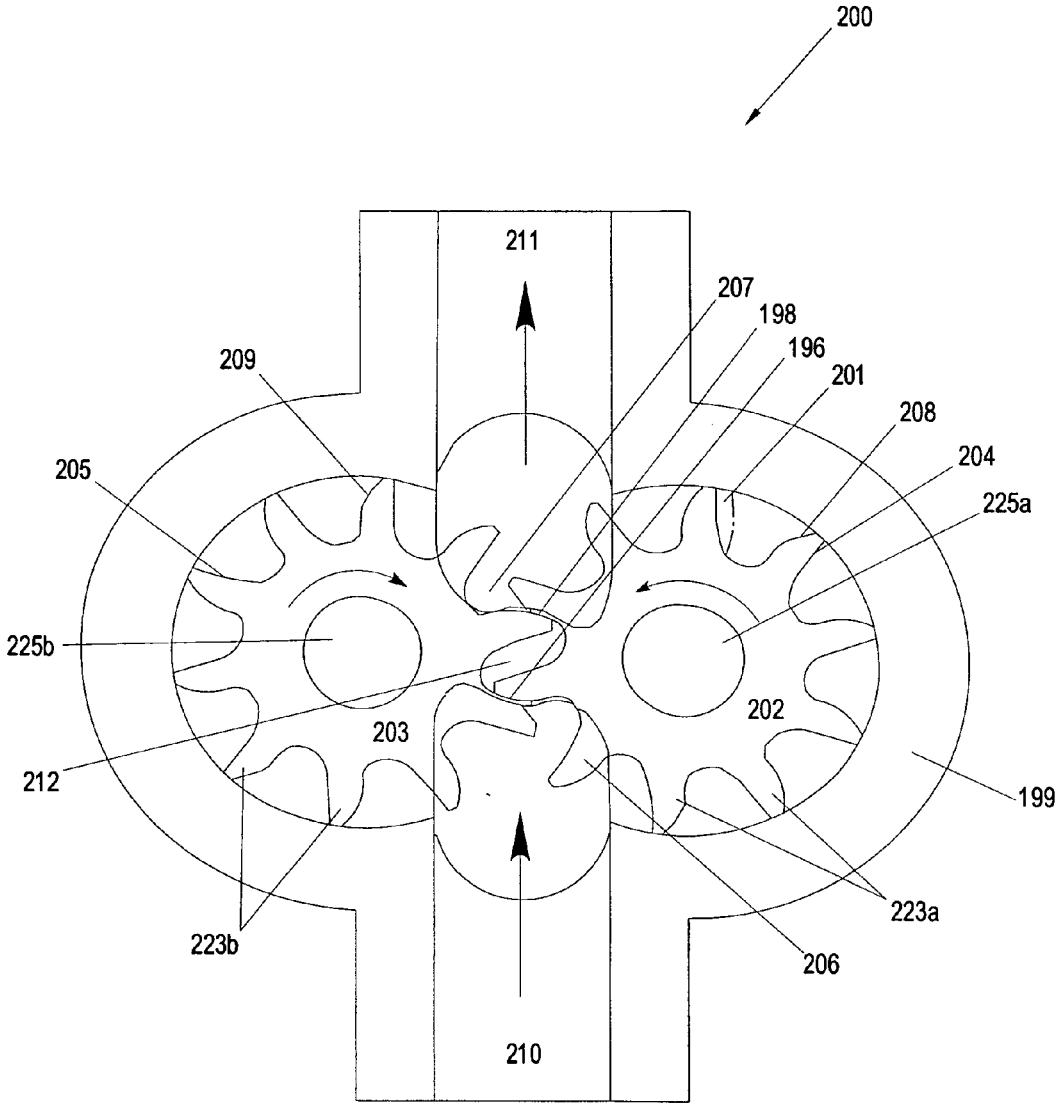
FIG. 2 is a schematic illustration of a top plan view of an exemplary embodiment of a pump having certain features and advantages according to the present invention.
Figure 5:
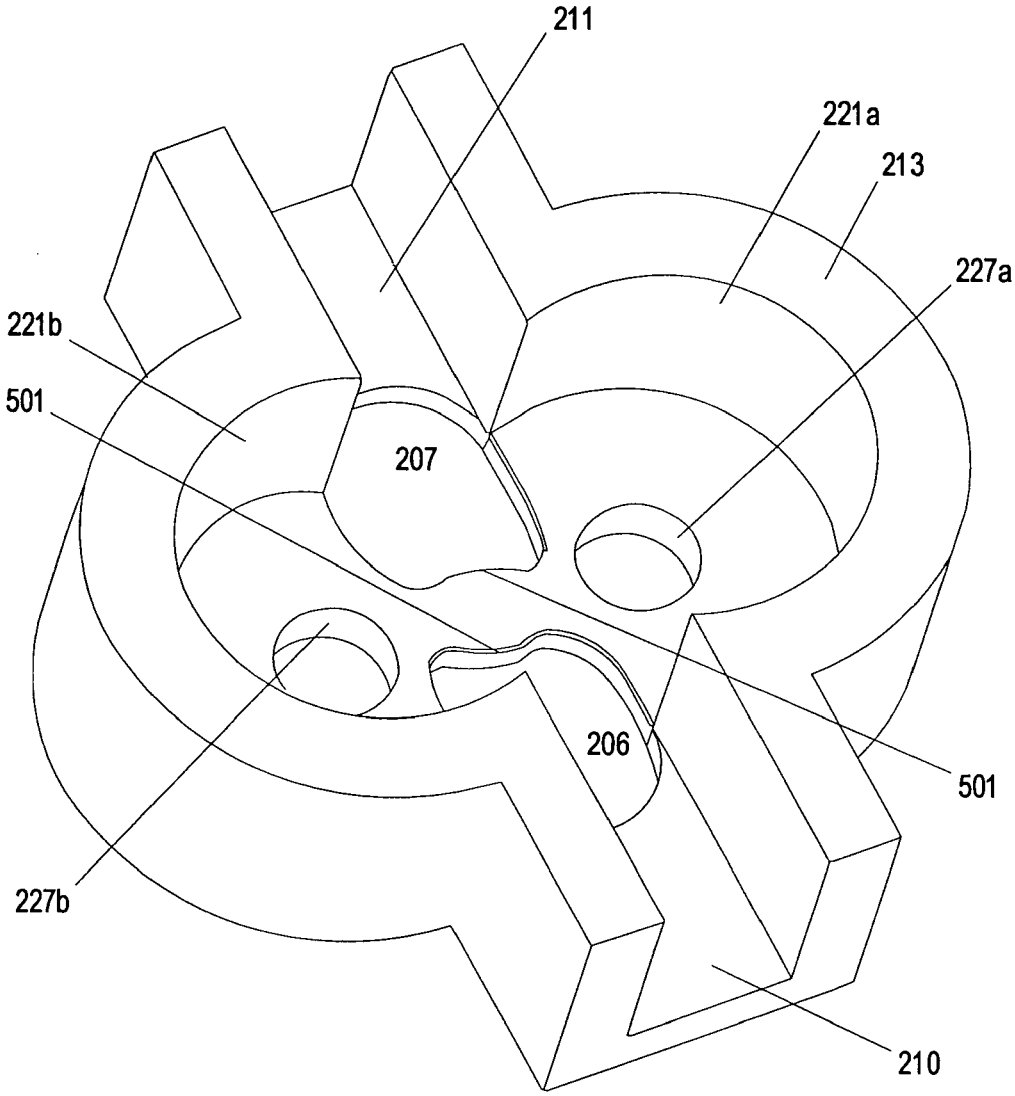
FIG. 5 is a side perspective view of a casing of the pump of FIG. 2.

The exemplary pump 200 comprises a casing 199 and a pair of opposing rotors 202, 203, with intermeshing gear teeth 223*a*, 223*b*. As seen in FIGS. 2 and 5, the casing 199 defines an inlet port 210, an outlet port 211 and a pair of annular recesses 221*a*, 221*b* with circular bearing surfaces 227*a*, 227*b* or other similar structures for supporting the rotors 202, 203 for rotation about a shaft 225*a*, 225*b*.

With particular reference to FIG. 2, the design of the teeth 223*a*, 223*b* has certain similarities to the prior art embodiment described above. However, in the exemplary embodiment, a side 201 of the gear teeth is relieved or removed as indicated by the dashed lines. By removing material from the gear teeth, a trailing face 204 of the driving rotor 202 and/or a leading face 205 of the driven rotor 203 are recessed with respect to their corresponding leading and trailing faces 208, 209. As will be explained in more detail below, the casing 199 may be provided with an inlet axial-port relief 206 and/or a discharge axial-port relief 207 such that a positive seal 196 and/or 198 is formed between the two rotors 202, 203 and the casing 199 with seal surfaces between the rotors 202, 203 being formed only between the leading faces 208 of the driving rotor 202 and the trailing faces 209 of the driven rotor 203.

The exemplary embodiment has several advantages. For example, an improved operating principle may be established which provides an improved seal between the rotors 202, 203 even if manufacturing tolerances are low. In addition, as will be explained in more detail below, any wear that occurs between the seal surfaces 208, 209 will not increase the clearance between these faces because a contact seal will exist between these faces 208, 209 due to the discharge pressure, which will cause the driven rotor to resist forward rotation. This allows the rotor faces to "wear in" to each other during initial service which will reduce the need for high manufacturing tolerances which will, in turn, reduce the cost of the pump. The ability of the gear teeth 223*a*, 223*b* to maintain a positive seal even with significant wear is believed to enable the pump 200 to operate far longer without maintenance and/or replacement than a conventional gear pump, especially when pumping abrasive fluids.

With continued reference to FIG. 2, the leading faces 208 of the driving rotor 202 maintain a positive contact pressure against the trailing faces 209 of the driven rotor 203 due to the pressure of the fluid in the discharge port 211, which press the faces 208, 209 together thereby providing an efficient seal. As a result, this embodiment allows the sealing faces 208 of the driving rotor 202 and/or the sealing faces 209 of the driven rotor 203 to experience significant wear without reducing the seal effectiveness between the sealing faces 208, 209 of the rotors 202, 203.

Figure 2B:
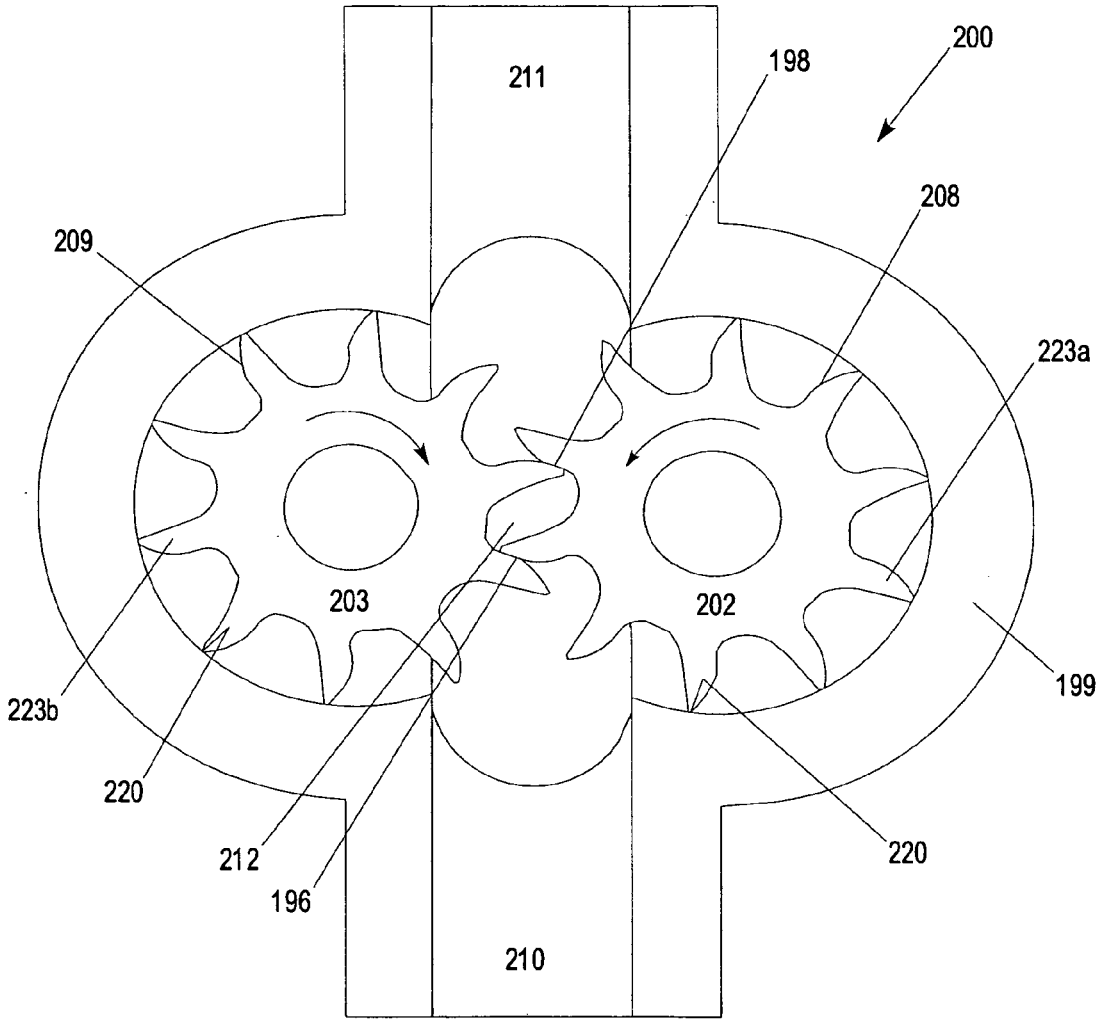
FIG. 2*b* is a schematic illustration of a top plan view of another exemplary embodiment of a pump having certain features and advantages according to the present invention.

FIG. 2B illustrates the pump 200 of FIG. 2 with significant wear on the contact faces 208, 209 of the rotors 202, 203. As the sealing faces 208, 209 of one or both rotors 202, 203 wear down from contact with each other or from the presence of abrasives in the fluid being pumped, the driving rotor 202 will advance slightly relative to the driven rotor 203 and/or the driven rotor 203 will rotate backward slightly relative to the driving rotor 202 so that a contact seal 196 and/or 198 is maintained between the teeth 223*a*, 223*b*. This relative rotation of one or both rotors 202, 203 will allow the pump 200 to seal effectively until there is no longer sufficient material left on the teeth 223*a*, 223*b* to provide the strength to pump at the discharge pressure or until one or more of the sealing faces 208, 209 wears enough to reduce the rotor tip diameter so it no longer provides an adequate seal against the casing 199 at the gear tooth tips 220.

The exemplary pump 200 may utilize different configurations of inlet and outlet ports each having particular advantages. In the exemplary embodiment illustrated in FIGS. 2–5, the pump 200 utilizes radial ports 210, 211, which define an inlet and outlet flow axis that extend in a generally radial direction with respect to the rotors 202, 203. As will be explained in more detail below, FIG. 6 illustrates a modified embodiment that includes axial ports 213, 216, which define a flow path that is generally perpendicular to the radial direction and parallel to the axis of rotation of the rotors 202, 203.

In the embodiments illustrated in FIGS. 2*b* and 5, the radial ports, 210, 211 allow fluid to flow to and from the chambers 212 formed between the meshing rotor teeth 223*a*, 223*b* during the beginning of the volume reduction of these chambers 212 on the discharge side, and during the end of volume increase of these chambers on the intake side.

As each chamber nears the lowest volume position 212 (see e.g., FIG. 2), however, the chamber becomes sealed to the discharge port by the engagement of the subsequent meshing teeth. Therefore, the illustrated embodiment includes an axial port recess 207 (see FIG. 5) for the fluid to displace into if a high pressure spike between the rotors is to be avoided. Similarly, as each chamber moves away from the lowest volume position, the chamber 212 remains sealed to the intake port 210 by the engagement of the proceeding teeth on each of the rotors 202, 203 and requires an axial port recess 206 (see FIG. 5) from which to draw in fluid if a low pressure spike between the rotors is to be avoided.

Figure 6:
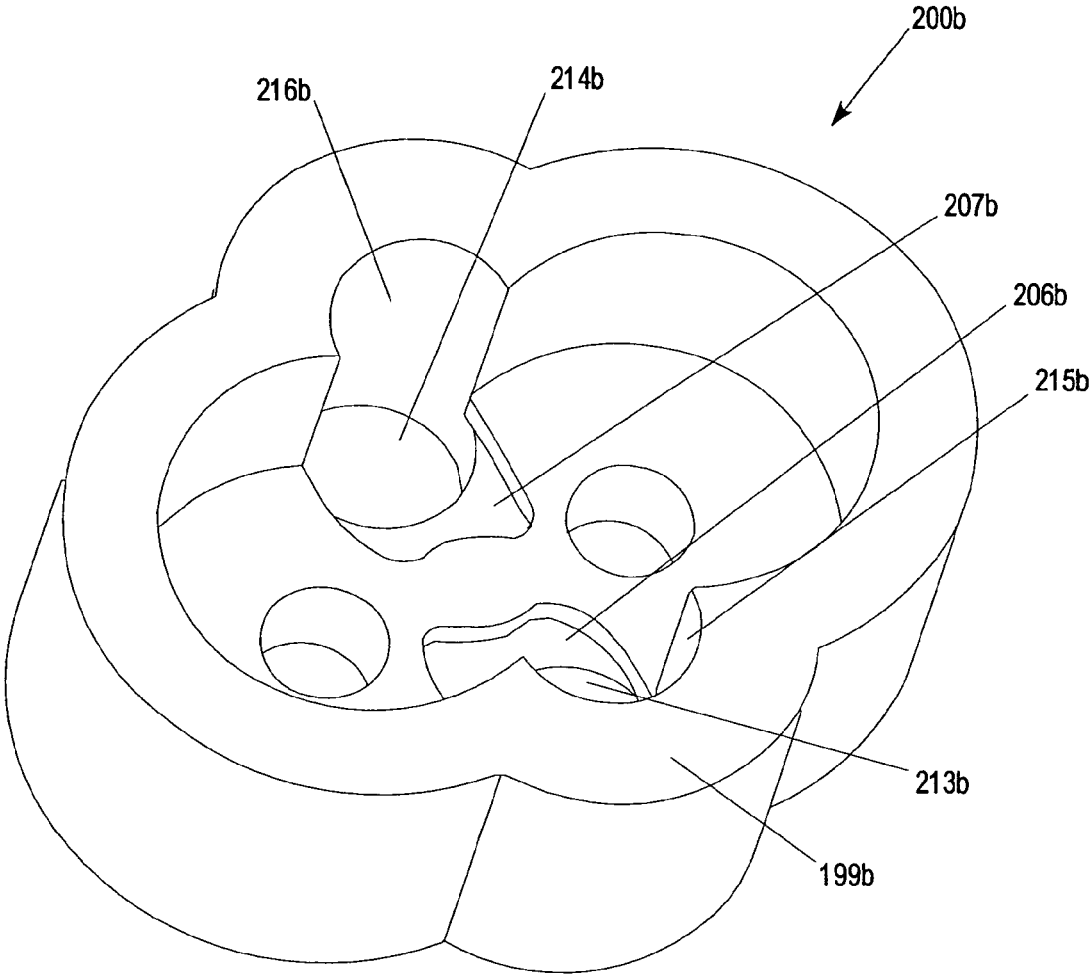
FIG. 6 is a modified embodiment of the casing of FIG. 5 having certain features and advantages according to the present invention.
Figure 6A:
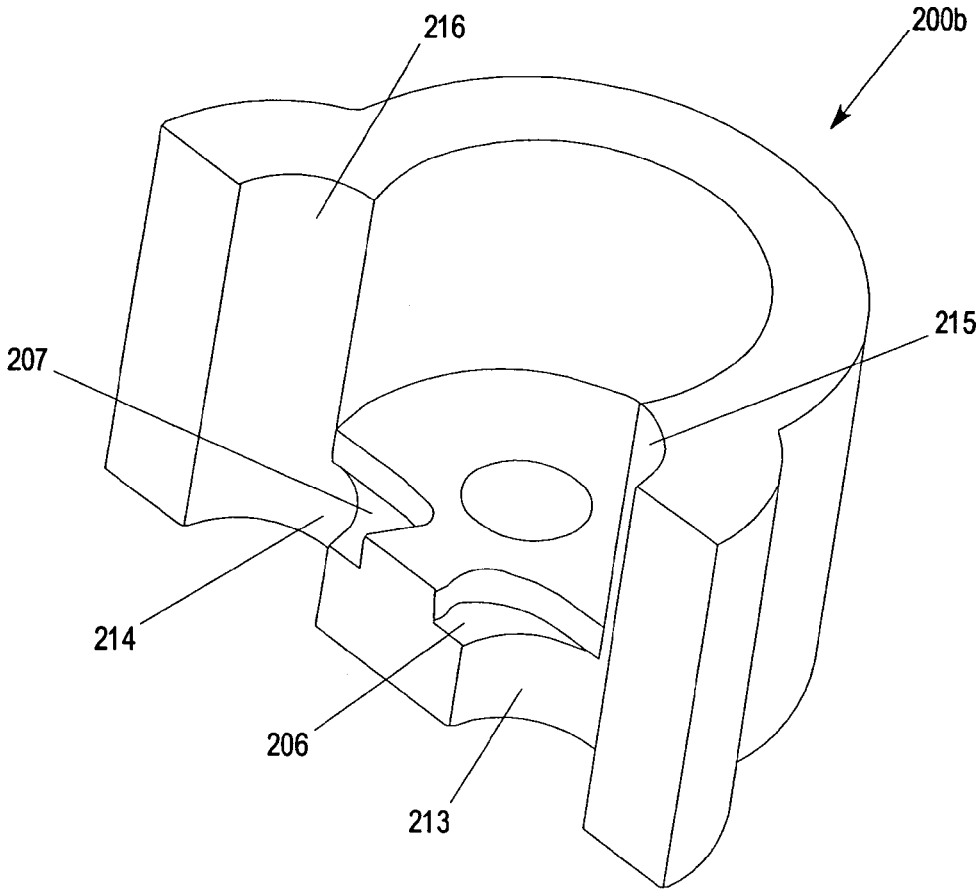
FIG. 6*a* is a cross-sectional view of the casing of FIG. 6.

FIGS. 6 and 6*a* illustrate an embodiment of the pump 200*b*, which includes axial ports 213*b*, 216*b*, which define a flow path that is generally perpendicular to the radial direction. As shown, the casing 199*b* includes the axial ports 213*b*, 214*b* radial port casing recesses 215*b*, 216*b* and axial port recesses 206*b*, 207*b* as described above.

Figure 7:
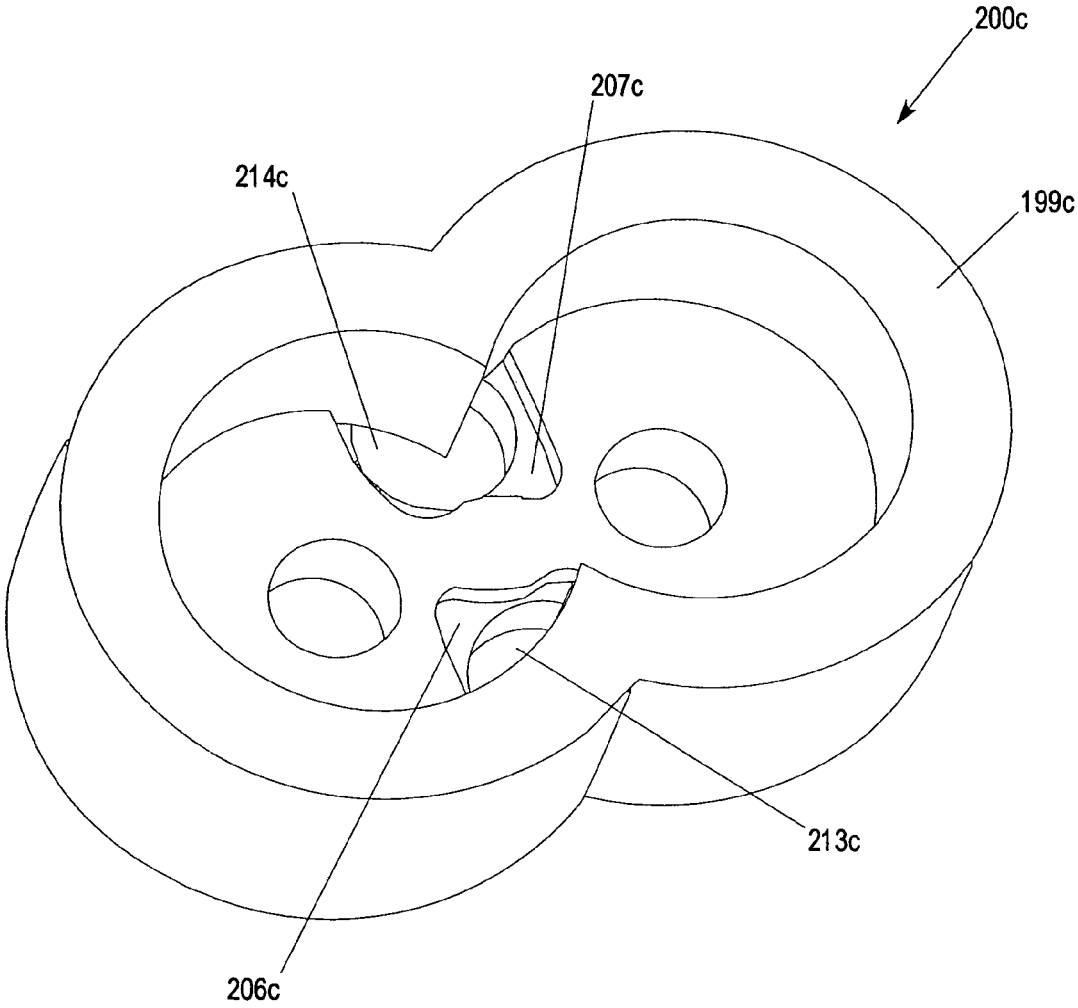
FIG. 7 is a modified embodiment of the casing of FIG. 6 having certain features and advantages according to the present invention.
Figure 7A:
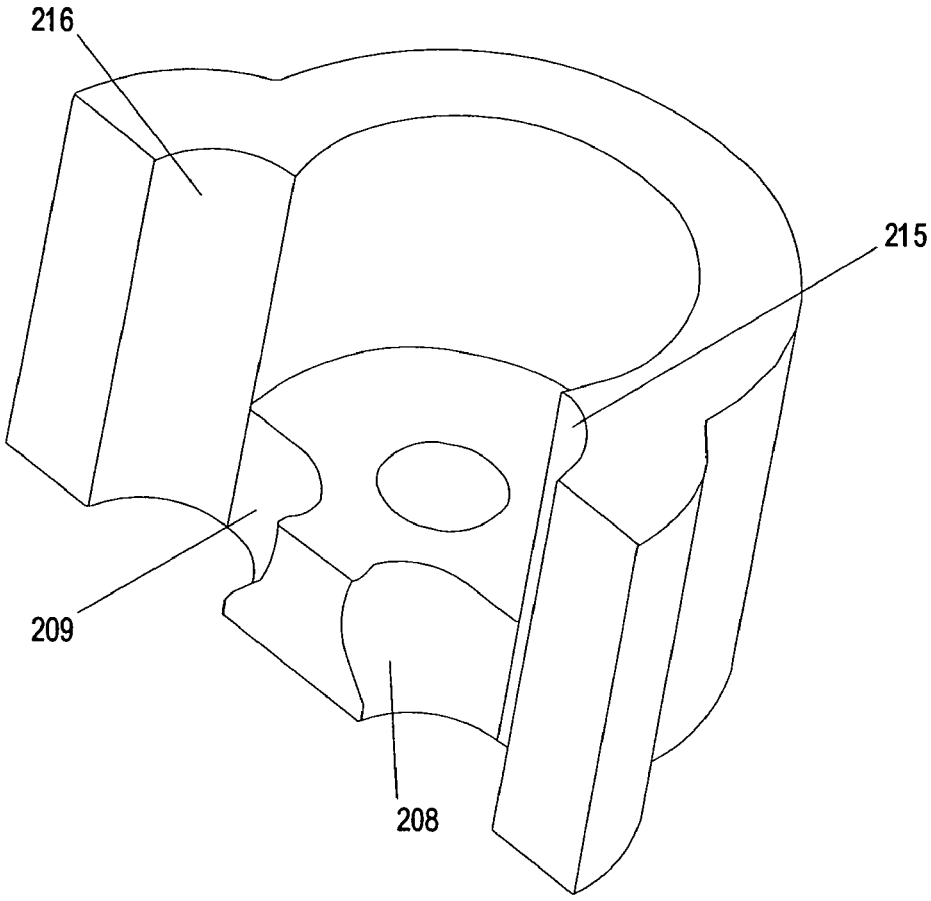
FIG. 7*a* is a cross-sectional view of the casing of FIG. 7.

FIG. 7 illustrates another embodiment of the pump 200*c*. In this embodiment, the pump 200*c* includes a modified casing 199*c* with purely axial ports 213*c*, 214*c* with no axial port recesses (as compared to the embodiment illustrated in FIG. 6*a*). This embodiment may result in higher fluid flow resistance as compared to the embodiment of FIG. 6*a*.

In addition to the embodiments described above, various port combinations and sub-combinations are also possible. For example, the pump may include radial ports only or axial ports only or various combinations of these two port types. In most embodiments, it is only required that there be an axial intake port 213 or port recess 206 to avoid a vacuum spike between the rotors just after the chamber 212 is momentarily or briefly formed for part of the rotation, which could cause the driven rotor 203 to advance rotationally and disengage the sealing surfaces 196, 198. This situation tends to happen if the negative pressure of the vacuum spike exceeded the discharge pressure. As such, the preferred embodiment utilizes an axial intake port 213 or port recess 206 at one end face of the rotors 202, 203 or more preferably at both ends of the rotors. A discharge axial port 214 or axial port recess 207 would also increase certain performance characteristics of the pump but may not be necessary for operation in all situations.

Radial ports as described above with reference to FIGS. 2–5 may offer convenience benefits for plumbing depending on the application. As mentioned above, a purely axial port casing design FIG. 7 could have a radial port effect of reduced flow resistance by providing casing recesses in the areas 215, 216 (FIG. 6) of the rotor engagement and disengagement. Purely axial ports 213*c*, 214*c* are shown in FIG. 7. Purely axial ports may be advantageous for certain pump configurations.

Figure 3:
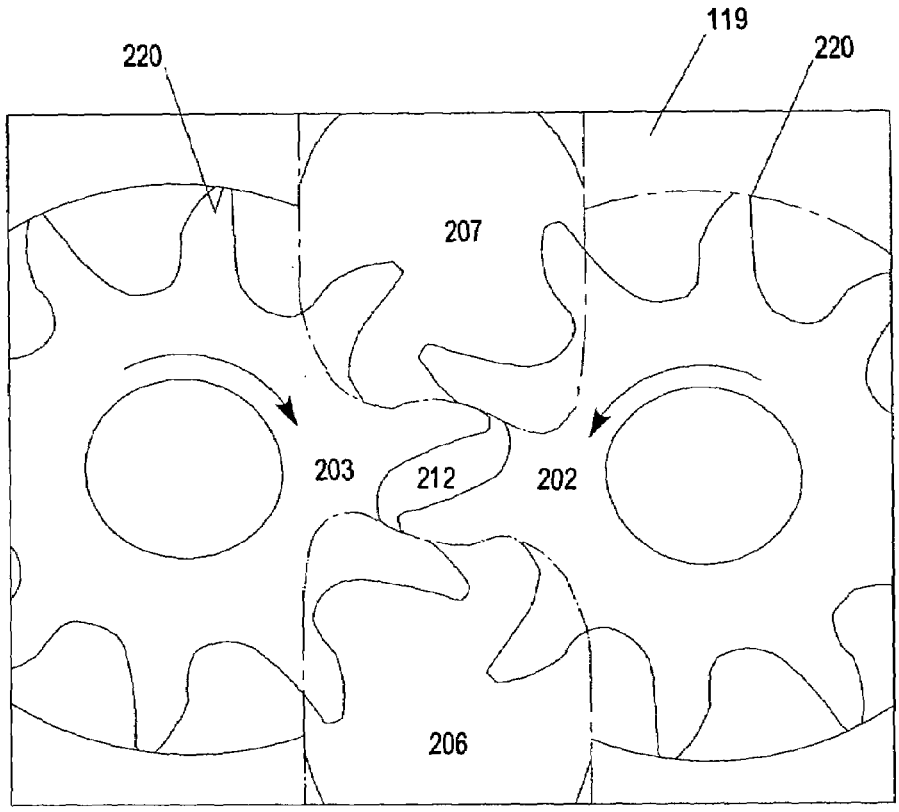
FIG. 3 is a closer view of a portion of the pump of FIG. 2 with a zero degree dwell angle.
Figure 4:
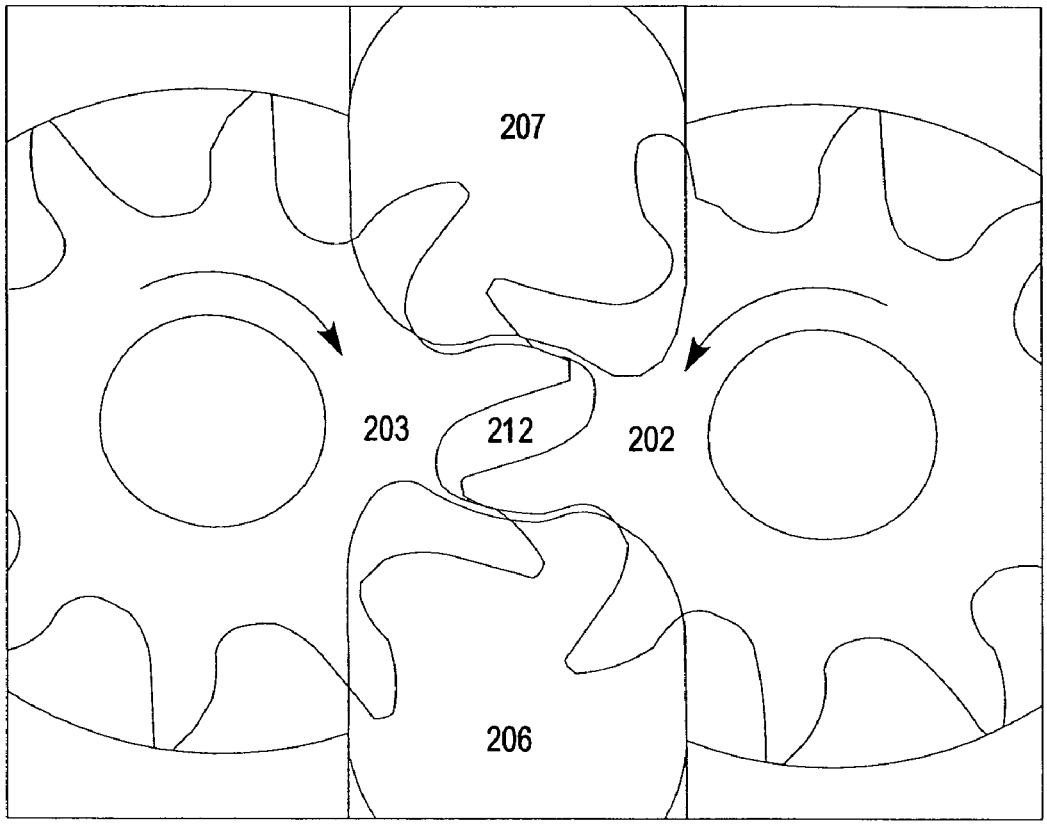
FIG. 4 is a closer view of a portion of the pump of FIG. 2 with greater than zero degree dwell angle.

With initial reference to FIGS. 2*b* and 3, a consideration in the design of the axial port recesses 206, 207 or axial port 210, 211 is what will be referred to as the dwell angle. The dwell angle is the angular rotation of the rotors 202, 203 on one side or the other of the lowest chamber volume position when the chamber 212 is sealed between the contact surfaces 208, 209 of the teeth of the two rotors 202, 203 and between the end faces 1601, 1602 (see FIG. 16*a*) of the rotor teeth and the casing 119. The dashed line in FIG. 3 shows inlet and discharge axial port recesses 206, 207 with a dwell angle of 0 degrees. In FIG. 4, the dashed line shows inlet and discharge port recesses 206, 207 with a dwell angle of approximately 2 degrees.

Generally speaking, a dwell angle of 0 degrees or less will result in a smoother running pump, but will exhibit reduced volumetric efficiency as more leakage will occur. A dwell angle of greater than 0 degrees will result in increased noise and vibration due to pressure and vacuum spikes in the chamber 212, but in certain embodiments this may be preferable to increase volumetric efficiency and pressure capability. In one preferred embodiment, the pump includes a positive dwell angle of several degrees combined with the addition of rounded edges 501 (see FIG. 5) on the axial port recesses 206, 207, or axial ports 210, 211. Such rounded edges 501 will help prevent wear of the port 210, 211 or port recess 206, 207 edges over time, especially when pumping abrasive fluids or slurries. As shown in FIG. 5, in the preferred embodiment, the rounded edges 501 generally follow the contour of the leading edges 208, 209, which form the chamber 212; however, in other embodiments of the contour may be modified from this shape.

It should also be noted that certain embodiments may use different dwell angles on the inlet and discharge sides of the pump to achieve different operating characteristics. For example, to prevent cavitation at higher operating speeds or lower inlet charge pressures, the inlet dwell angle may be reduced to 0 degrees or less to reduce or eliminate any vacuum spikes in the chamber 212 while increasing the discharge dwell angle to 2 or 3 degrees to assure that a positive seal is maintained at all times. This example of a different dwell angle on the inlet and discharge sides of the pump will operate with slightly higher levels of noise and vibration but this may be an acceptable compromise in applications where cavitation is a concern. Of course, for many applications, some routine experimentation or optimization may be beneficial to determine the ideal dwell angle to achieve the desired performance and to maintain a consistent fluid "creep" or "backflow" at all times during the rotation of the rotors.

Figure 8:
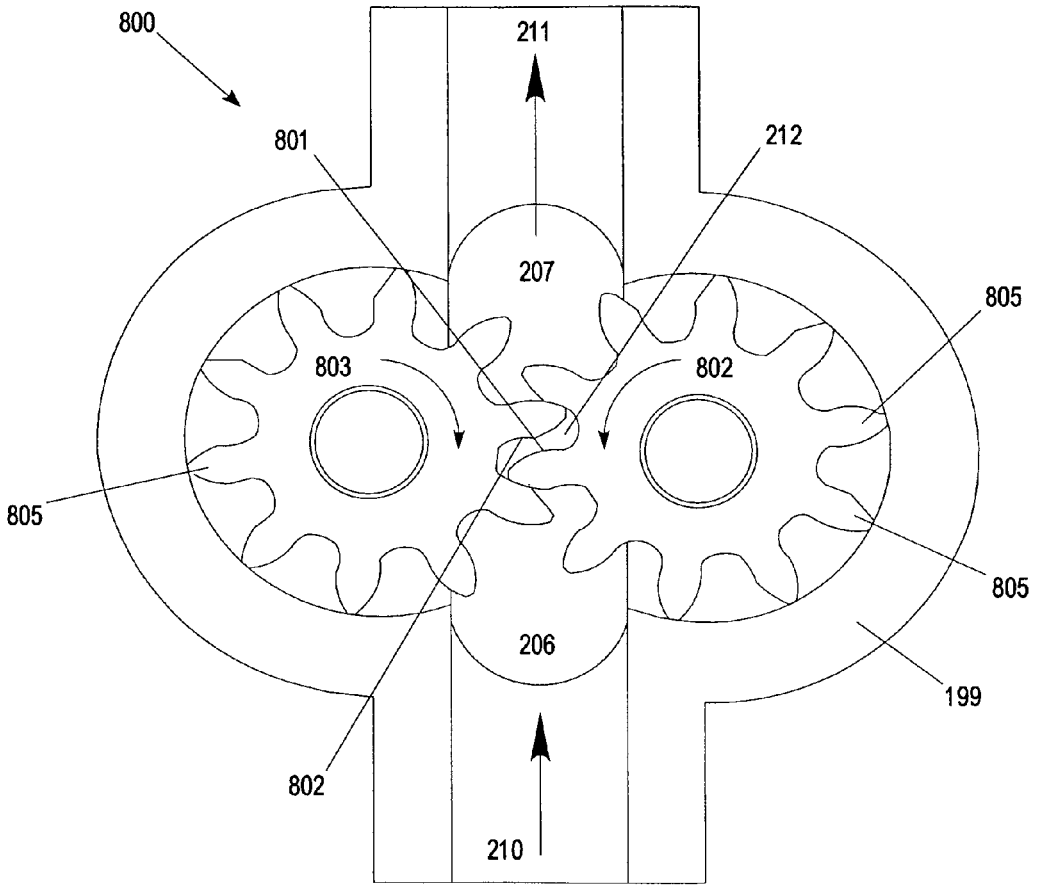
FIG. 8 is a schematic illustration of a top plan view of another exemplary embodiment of a pump having certain features and advantages according to the present invention.
Figure 9:
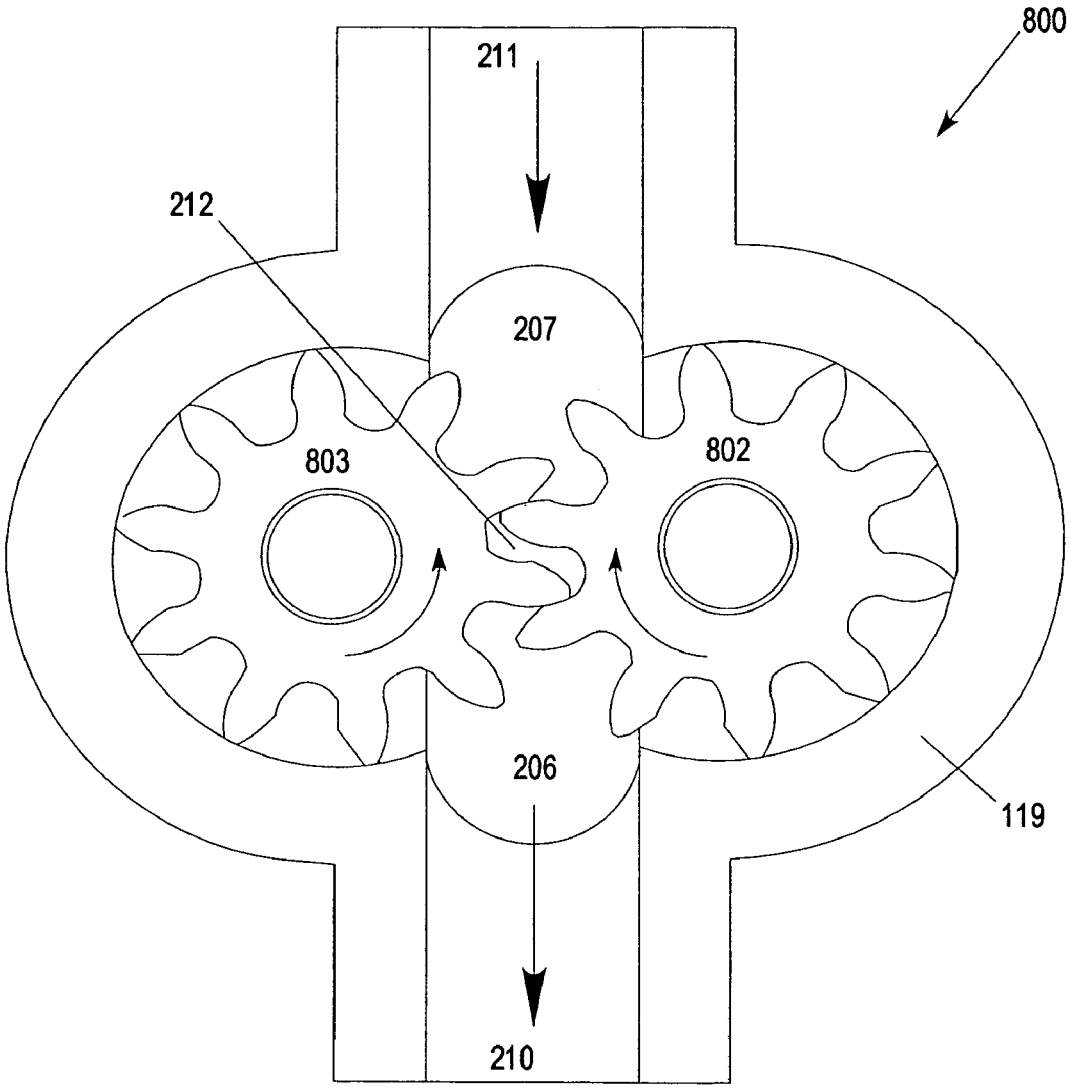
FIG. 9 is a schematic cross-sectional illustration of the pump shown in FIG. 8 running in the opposite direction.

FIGS. 8 and 9 illustrate another exemplary embodiment of a pump 800 having certain features and advantages according to the present inventions. In this embodiment, similar reference numbers have been provided for parts that are similar to parts described above. As shown in FIGS. 8 and 9, the rotors 802, 803 are designed with gear teeth 805 that are similar in shape on the leading and trailing edges (e.g., the gear teeth 805 are generally symmetrical). To achieve the effect of removing material from the trailing face 204 of the driving rotor 202 and/or the leading face 205 of the driven rotor 203 as described above, the rotors 802, 803 are provided with sufficient "backlash" to allow relatively unrestricted flow of fluid through the space between the unsealed areas between the trailing surface 801 of the teeth 805 of the driving rotor 802 and the leading surface 802 of the teeth 805 of the driven rotor 802. As shown in FIG. 9, such a pump 800 would have the ability to pump equally or nearly equally as well when operated in a reversed direction.

Figure 10:
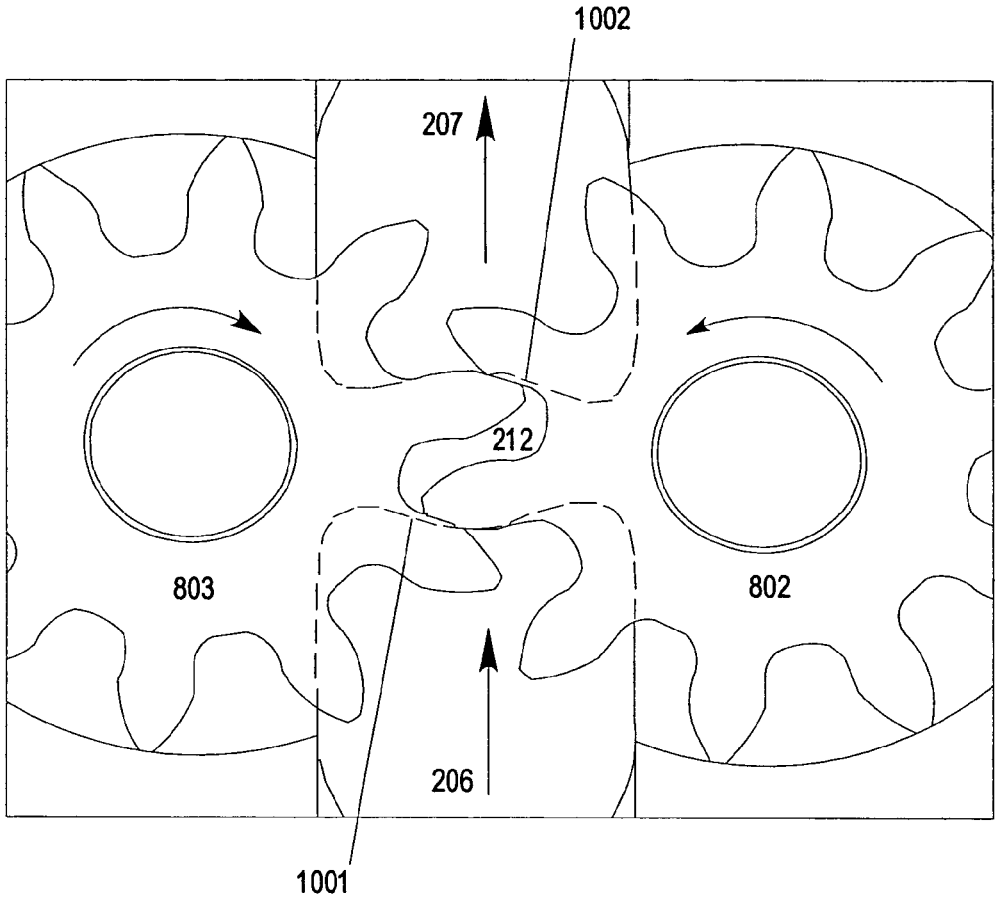
FIG. 10 is a closer view of a portion of the pump of FIG. 8 with a zero degree dwell angle.
Figure 11:
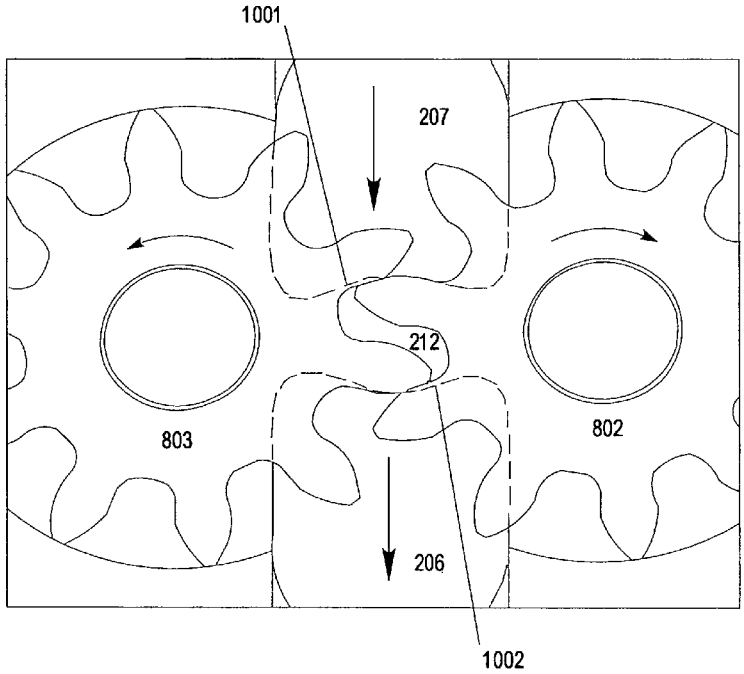
FIG. 11 is a closer view of a portion of the pump of FIG. 8 with a zero degree dwell angle and running in the direction shown in FIG. 9.

In this embodiment it may be advantageous to use a "universal" port recess shape which seals the lowest volume position of the chambers 212 with the desired dwell angle when the pump is pumping forward (FIG. 8) as well as when the pump is pumping in reverse (FIG. 9). A universal reversible port shape with a dwell angle of approximately 1 degree is shown in FIG. 10 with the pump operating in the forward direction and in FIG. 11 with the pump operating in the reverse direction. In both directions it can be seen that the area 212 is sealed momentarily at the lowest volume position and for 1 degree on either side of this position because the edge 1001, 1002 of the axial ports (not shown) or axial port recesses 206, 207 is aligned with the edge of the meshing teeth at 1 degree of rotor rotation on either side of the position which forms the chamber 212 in FIG. 10 and FIG. 11.

Figure 12:
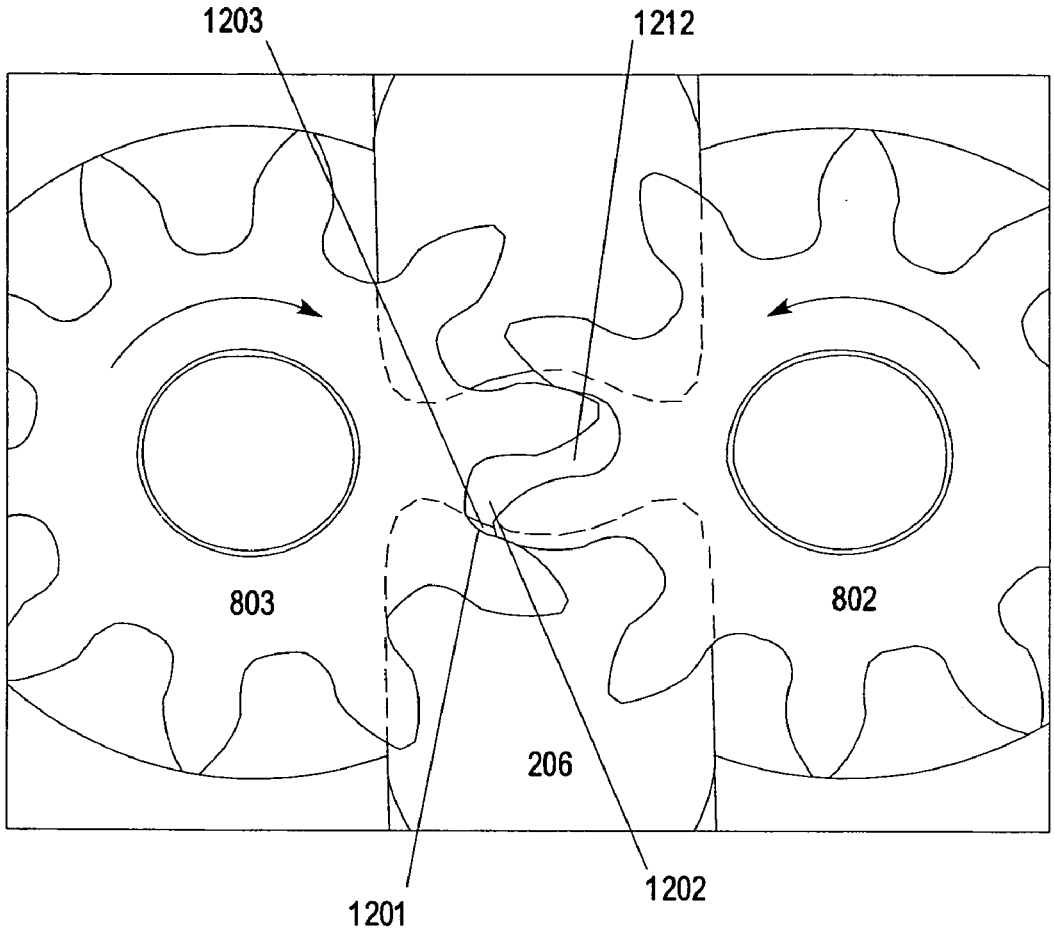
FIG. 12 is a closer view of a portion of the pump of FIG. 9 with a greater than zero degree dwell angle.

This axial port or axial port recess edge 1001, 1002 alignment is advantageous in order to achieve as large an area as possible for the fluid to enter and exit the chamber between the rotors on either side of the lowest volume 212 position. FIG. 12 shows the increased backlash embodiment with the rotors 802, 803 at approximately 3 degrees past the lowest chamber volume position 212. In this position the trailing edge 1201 of the driven rotor 803 has just entered the axial inlet port recess 206 allowing fluid 1202 to flow into the chamber 1212 through the opening 1203.

Figure 13:
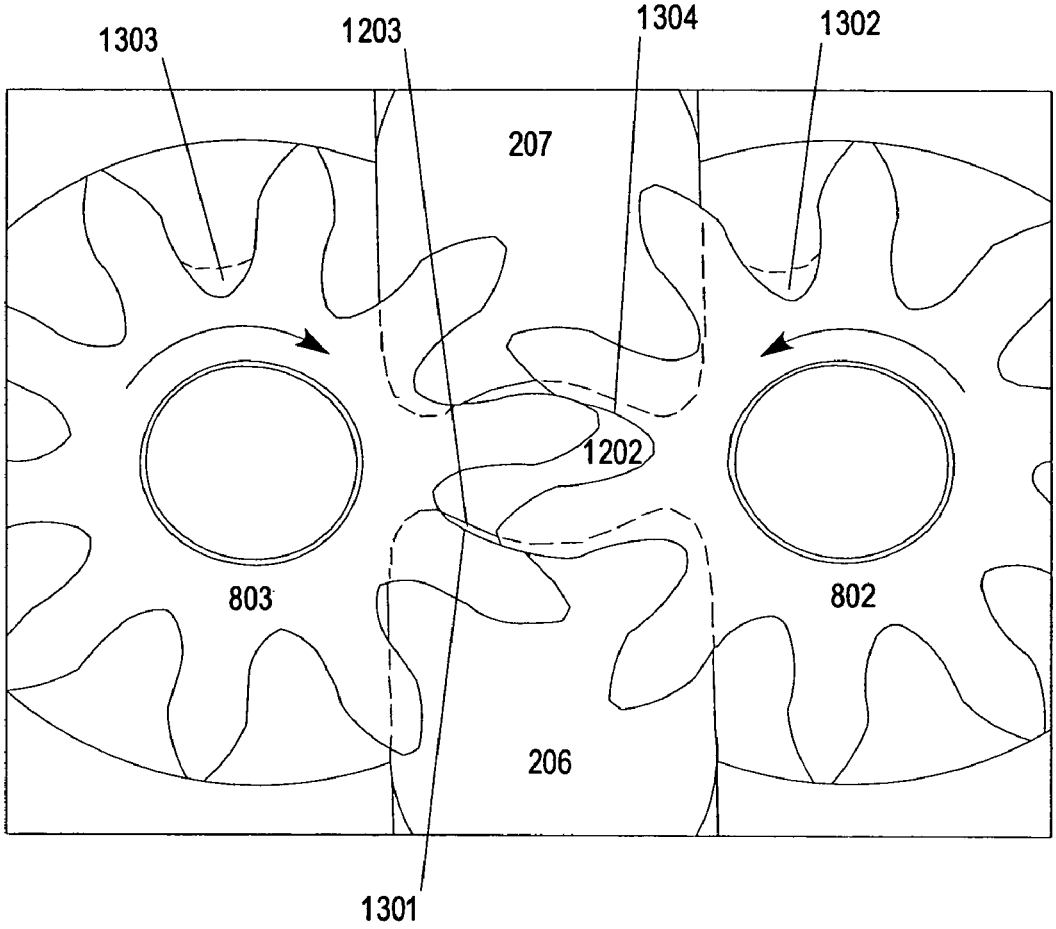
FIG. 13 is a closer view of a portion of the pump of FIG. 9 with material removed from the smallest diameter of the gear teeth.

To reduce turbulence and fluid flow resistance, it is advantageous for this opening 1203 to become as large as possible as quickly as possible. Another method of accomplishing this is shown in FIG. 13 where material has been removed from the rotors 802, 803 in the space between the teeth 1302, 1303. The effect of this material removal is to increase the size of the opening 1203 as the trailing edge 1301 of the driven rotor 803 enters the intake axial port recess 206 or the leading edge 1304 of the driving rotor 802 leaves the discharge axial port recess 207. This material removal could be advantageous for many different rotor configurations and gear tooth profiles.

Figure 14A:
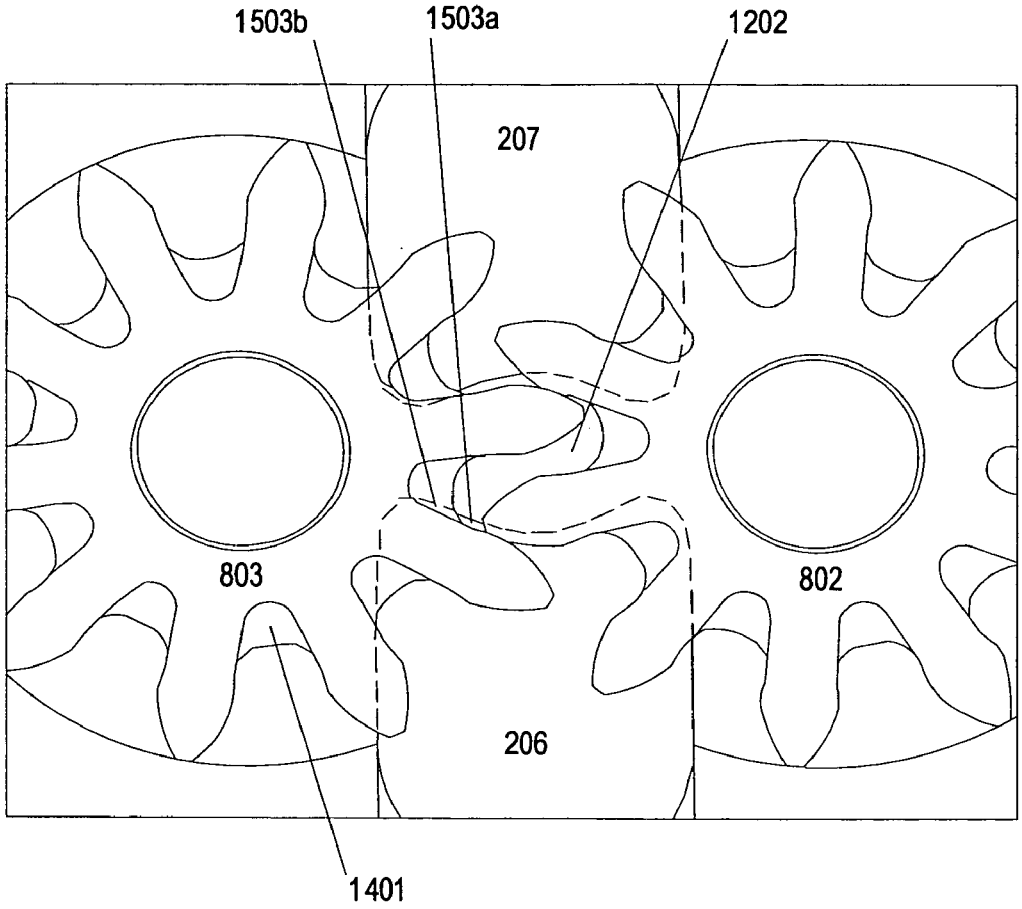
FIG. 14*a* is a closer view of a portion of a modified embodiment of the pump of FIG. 8.
Figure 14B:
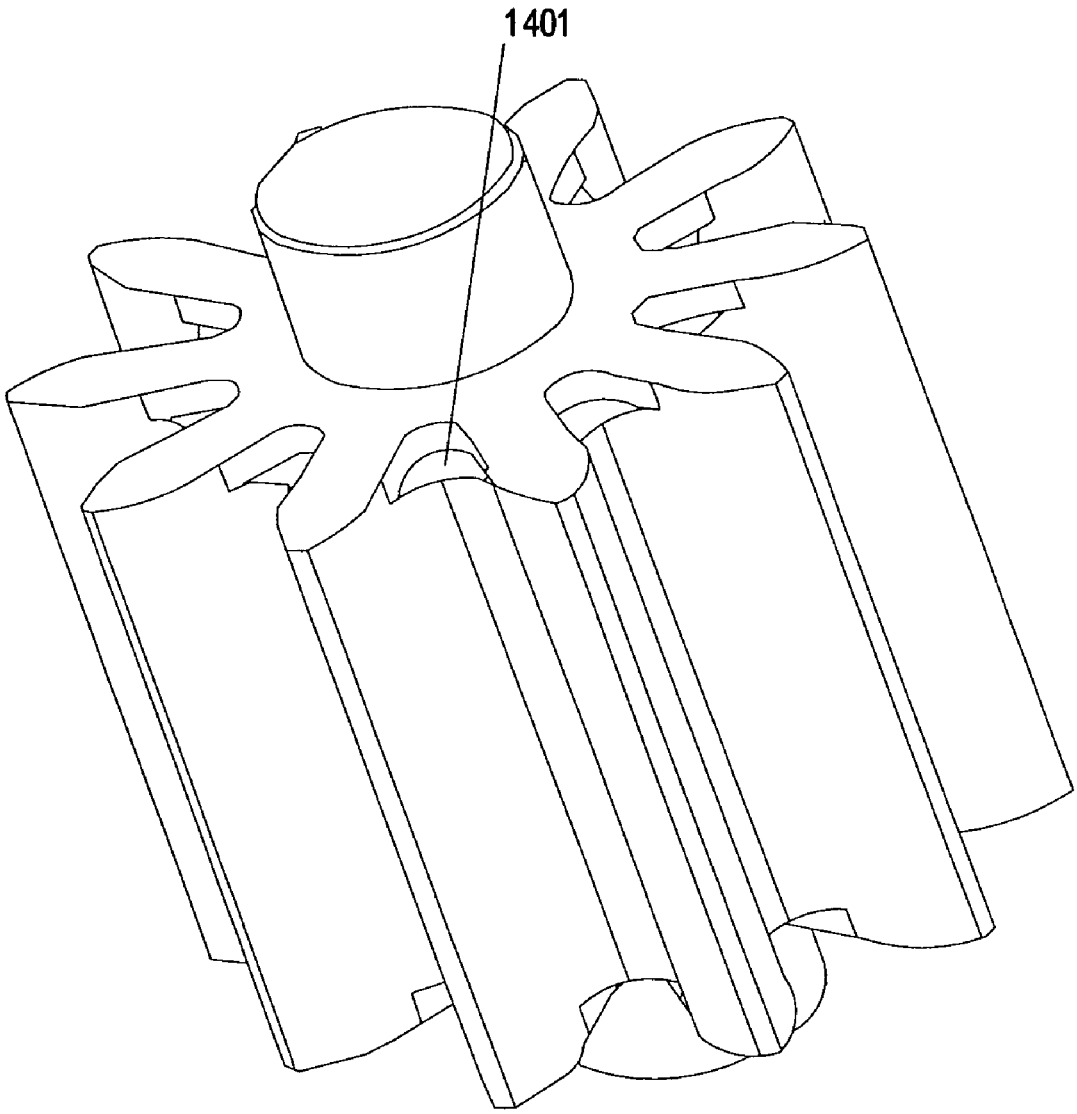
FIG. 14*b* is a side perspective view of a rotor of the pump of FIG. 14*a*.

FIGS. 14*a* and 14*b* show a preferred rotor embodiment to increase the opening 1202 size. In this embodiment, very little gear tooth strength is lost because only a recess 1401 is removed from the rotors. These recesses 1401 can be any depth and at one end or both ends of one or both rotors. The recess 1401 depth is shown in FIG. 14*b* allows significant reduction of fluid turbulence and velocity resulting in reduced pressure and vacuum spikes in the chamber 1202 without significantly reducing the strength of the gear teeth. In one embodiment which is particularly suited for gear pumps that require tight clearances, the recess 1401 has a depth of 0.005 to 0.050 inches. In another embodiment, the recess 1401 has a depth of approximately 0.1 inches for a 1 inch long rotor.

FIG. 14*a* shows the alignment of this rotor recess 1401 with the edge of the axial port 206 and how it more than doubles of the size of the opening 1503. For example, the reference number 1503*a* indicates the opening size that would exist without the recess 1401 while the reference number 1503*b* indicates the opening size with the recess 1401. A such, the recess 1401 together with the port shape illustrated in FIG. 14*a* produces approximately twice the cross-sectional area that would exist without the recess 1401.

Figure 15:
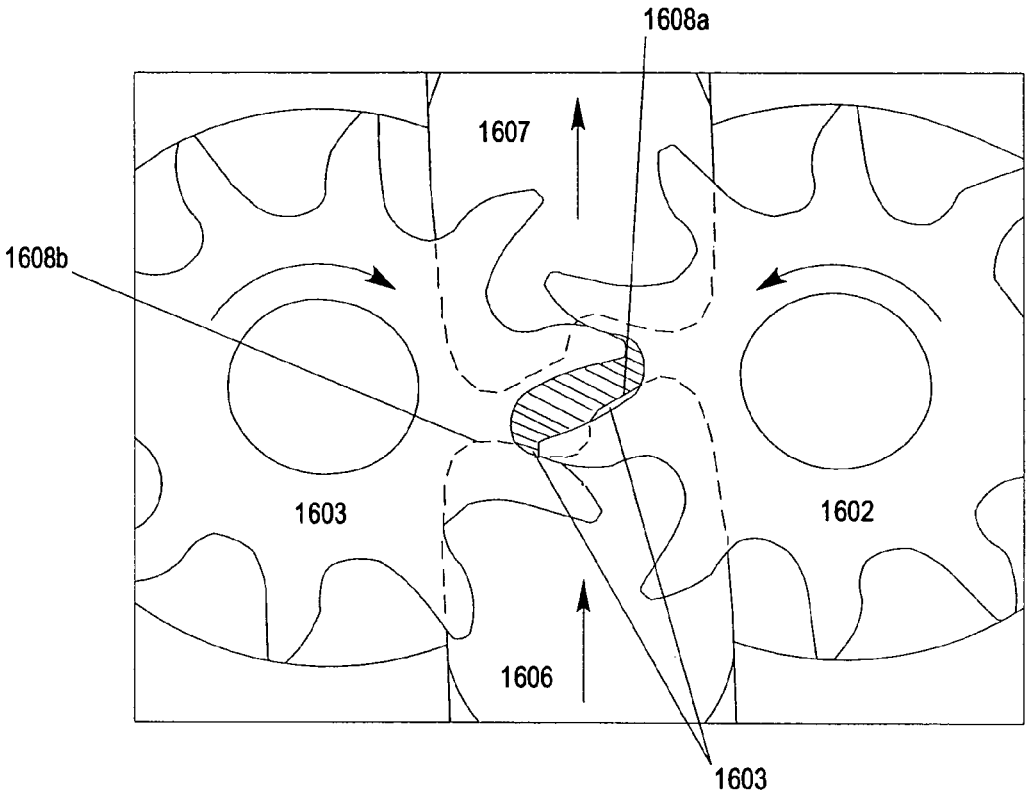
FIG. 15 is a closer view of a portion of a modified embodiment of the pump of FIG. 2.

FIG. 15 shows an modified port recess or port shape 1606, 1607 which increases the size of the opening 1603 without having to remove any material from the rotors. Specifically, as indicated by the hatched area in FIG. 15, the proximity of the recess edges 1608*a*, 1608*b* to the chamber 1202 increases the size of the opening 1603.

Figure 16A:
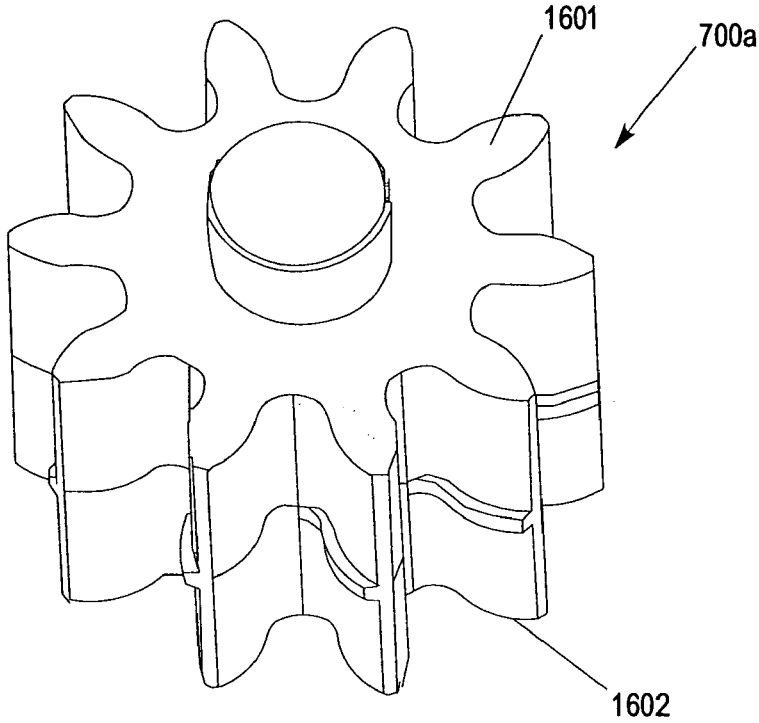
FIGS. 16*a*–*c* illustrate various embodiments of rotors having certain features and advantages according to the present invention.
Figure 16B:
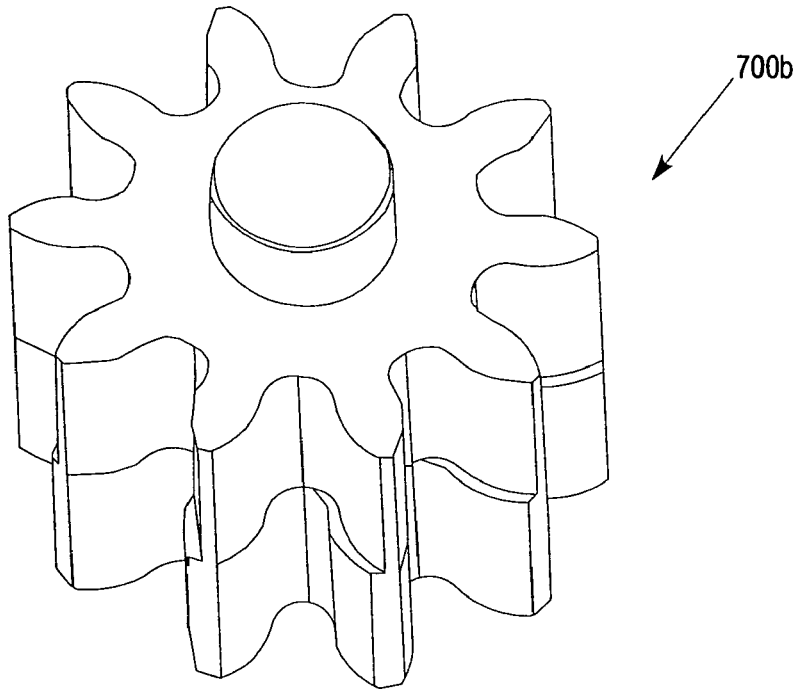
Figure 16C:
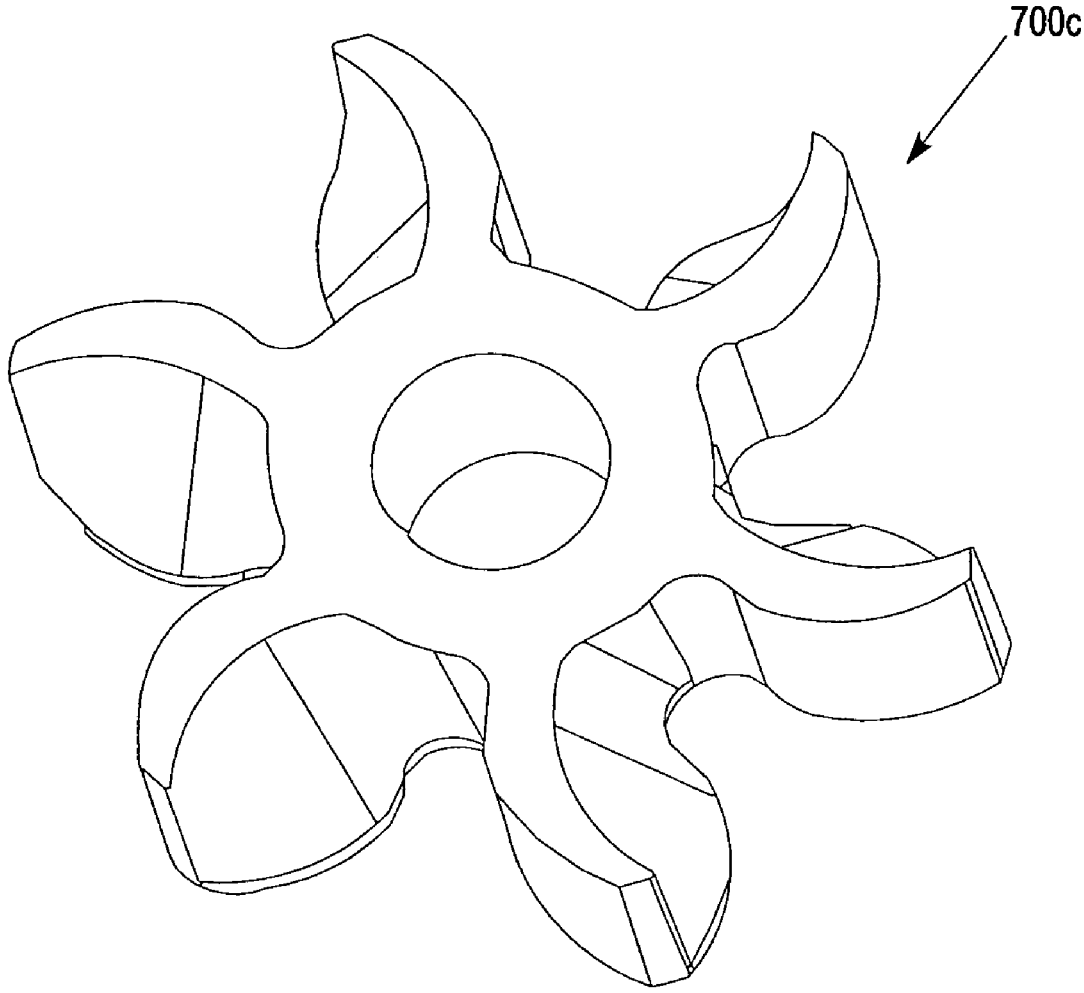

FIGS. 16*a* through 16*c* show various embodiments of rotors 700*a–c* with different gear tooth profiles that may provide at least some of the advantages described in above. These embodiments are merely exemplary and many other shapes and configurations of the rotor teeth which utilize such recesses are also conceivable. As explained above, in these embodiments, the gear teeth on one or both of the rotors are configured such that each rotor engagement zone has a sufficient space between the trailing face of the drive rotor teeth and the leading face of the driven rotor teeth so that a seal is not established between these faces. This space may be for the entire length of one or both rotors as shown in FIG. 2, and FIG. 13, or part of the length of one or both rotors as shown in FIG. 14, FIG. 16*a*, FIG. 16*b*, FIG. 16*c*.

It should be noted that the above description and drawings are of a simplified nature for clarity of explanation and have been used to represent pump configurations with many variations including greater of lesser number of gear teeth and rotors which could be larger or smaller in size. Also, port shapes and sizes are representative and in an actual pump could be smaller or larger or of a different shape as will be apparent to one of skill in the art.

A number of examples of pump configurations which would benefit from the port shapes and configurations and/or the gear tooth shapes and configurations as described above, will now be discussed. It should be noted that these examples do not comprise a complete list of possible pump configurations, but are only intended to demonstrate the wide range of potential applications, which may utilize the port shapes and configurations and/or the gear tooth shapes and configurations described above. As such, the gear tooth profiles mentioned above could be used for any of the following examples of pump configurations; however, for ease of discussion, the partially relieved gear teeth 202, 203 from FIG. 2 will be used in the following description and drawings.

Figure 17:
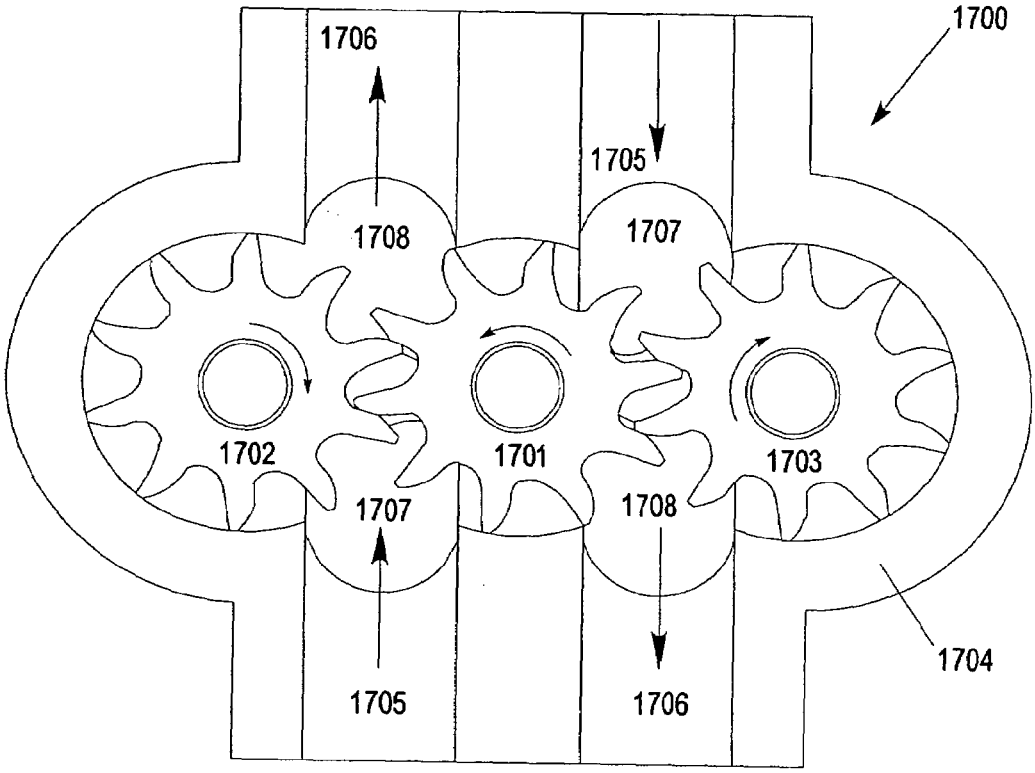
FIG. 17 is a schematic top plan view of another exemplary embodiment of a pump having certain features and advantages according to the present invention.

FIG. 17 shows an example of a three gear configuration pump 1700 with the top cover removed. The pump 1700 includes three rotors 1701, 1702, 1703 with intermeshing teeth and a casing 1704, which defines a pair of inlet and outlet ports 1705, 1706 and recesses 1707, 1708. As mentioned above, the pump 1700 may be formed with various rotor sizes and gear tooth numbers on each rotor. In addition, the number of rotors may also be varied.

Figure 18:
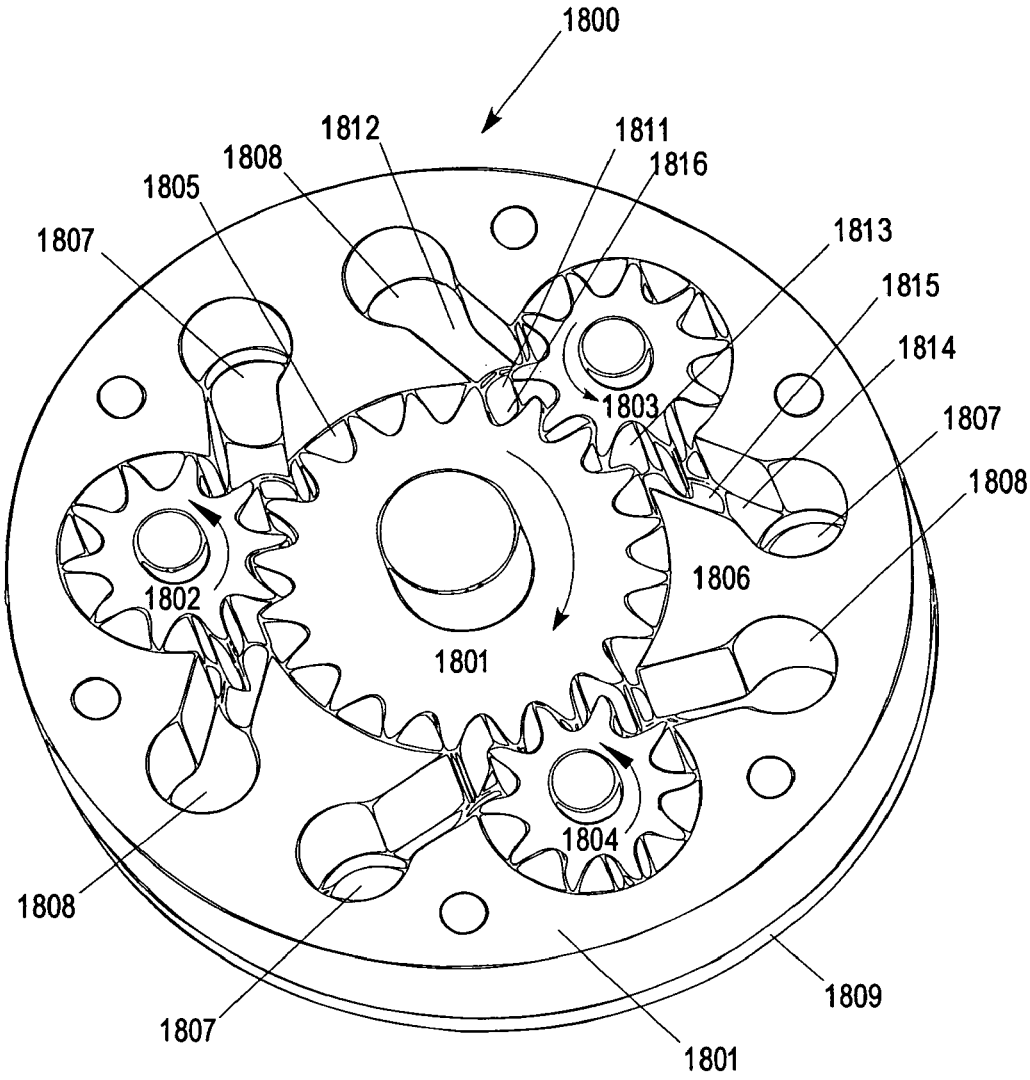
FIG. 18 is a schematic top plan view of an exemplary embodiment of a pump with four rotors having certain features and advantages according to the present invention.

FIG. 18 shows an example of a four rotor design pump 1800 with a top cover removed. This embodiment includes a casing 1806 in which three outside rotors 1802, 1803, 1804 that are driven by a central driving rotor 1801 are positioned. In modified embodiments, one or more of the outside rotors may be used to drive the remaining motors. Flow in and out of the pump could be through radial ports 1807, 1808, with axial port recesses 1811, 1815, as shown or any combination of ports or port recesses as described above.

Figure 19:
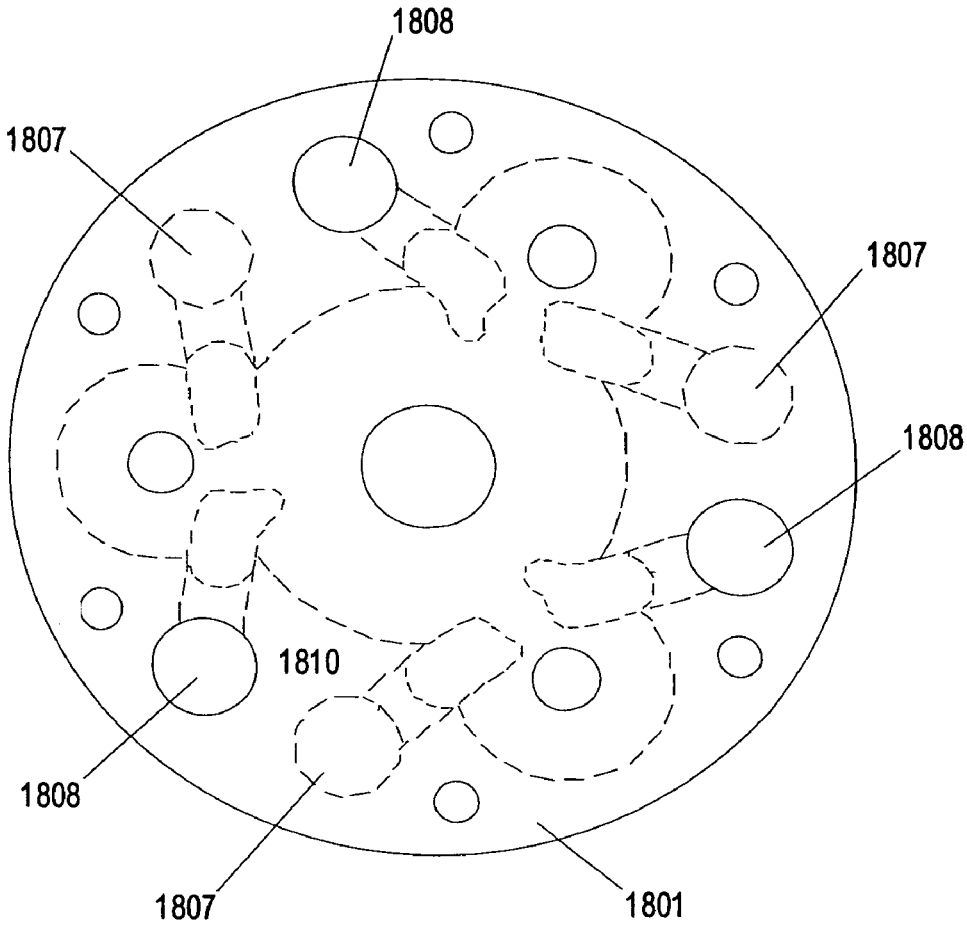
FIG. 19 is as top plan view of the casing of the pump of FIG. 18.

FIG. 19 shows the casing from the example pump 1800 of FIG. 18 with both casing covers and the rotors 1801, 1802, 1803, 1804 removed. The discharge ports 1808 are located in the top cover 1810 and the dashed lines show the location of the inlet ports 1807 in the bottom cover (not shown).

With reference back to FIG. 18, fluid is drawn into the pump 1800 through axial openings 1807. The fluid then travels through a intake radial conduits 1814 and the axial port intake recesses 1815 to the area 1813 where the rotor teeth are disengaging and drawing fluid into the expanding space between the teeth of the meshing rotors. The fluid then travels around between the teeth of the rotors and the casing 1806 to where these chambers are reduced in volume as the rotor teeth engage in area 1816. The fluid is then discharged from between the engaging rotor teeth and out through the discharge axial ports 1811 and the discharge radial port conduits 1812 and finally out the discharge ports 1808.

In this example embodiment, the larger inner rotor 1801 allows the use of multiple outer rotors 1802, 1803, 1804. In the embodiment of FIG. 17, multiple outer rotors 1703 (FIG. 17) can be used with an inner rotor 1701 of the same size. However, the larger inner rotor 1801 of the embodiment of FIG. 18 may advantageously provide more sealing length between the inner rotor 1801 and the casing 1806 along the interior face 1805 of the casing 1806. This area will be referred to as the "tooth tip to casing seal zone". In the illustrated, three rotor configuration there are always at least three teeth providing a seal between the inner rotor 1801 and the casing 1806 along the face of the casing 1805. This is advantageous for increased pressure capability and increased volumetric efficiency. More outside rotors 1802, 1803, 1804 can be used as long as the inner driving rotor 1801 is of sufficient size to provide a seal of at least one tooth at all times in the "tooth tip to casing seal zone."

It should be noted that any of the rotors could be the driving rotor, and that even more than one of the rotors could be a driving rotor at the same time. In the preferred embodiment, the inside rotor 1801 would be the only driven rotor for simplicity and minimized cost.

Figure 20:
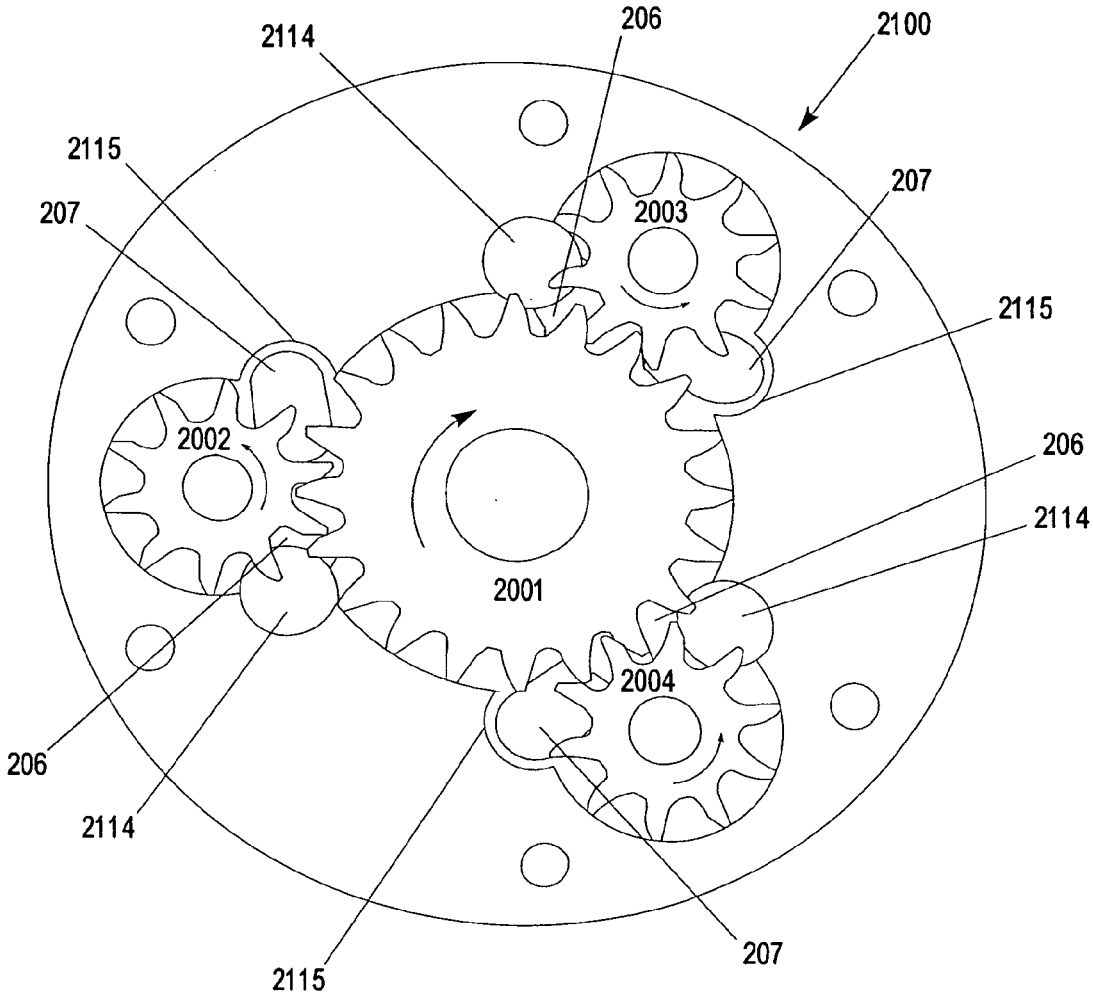
FIG. 20 is a top plan view of the pump of FIG. 18.

Many other combinations of the casing and port designs are also possible with the four rotor design described above. FIG. 20 illustrates a modified pump 2100 embodiment wherein the fluid enters and discharges from the pump 2100 from axial ports without the radial conduits 1812, 1814 of the embodiment shown in FIG. 18. FIG. 20 shows an example of this port configuration with the top cover removed so as to expose the inlet port recesses 207, discharge port recesses 206, and discharge axial ports 2114. Such a pump 2100 may have the advantage of reduced flow resistance as it does not require the fluid to change directions as many times as the previous embodiment and therefore may require less input power to do the same amount of hydraulic work.

In the example in FIG. 18, the number of teeth on the inside rotor 1801 is not divisible by the number of outside rotors 1802, 1803, 1804 so the rotational engagement of each of the outside rotors 1802, 1803, 1804 with the driving rotor 1801 will be different from each other at all times. This has the advantage of further reducing noise and vibration by staggering any output pulsation that may be inherent in a particular configuration.

Figure 21:
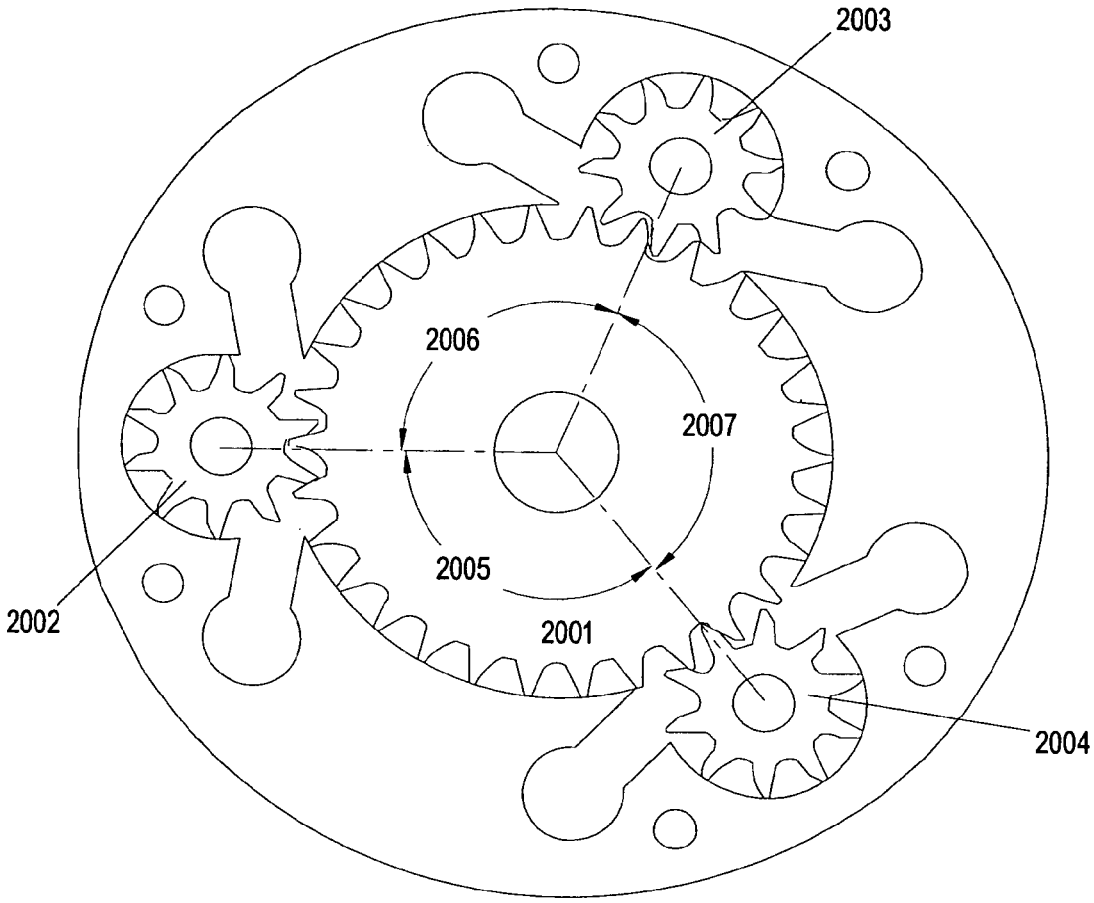
FIG. 21 is a modified embodiment of the casing of the pump of FIG. 18.

FIG. 21 shows how a staggered effect can be accomplished if the number of teeth on the driving rotor 2001 can be divided by the number of outside driven rotors 2002, 2003, 2004. In this embodiment, the axis of rotation of the outside driven rotors 2002, 2003, 2004 are positioned at various angles 2005, 2006, 2007 to each other to stagger the engagement of each outer rotor 2002, 2003, 2004 with the teeth of the inner driving rotor 2001. In this manner, a similar effect to the configuration in FIG. 18 can be accomplished.

Figure 32:
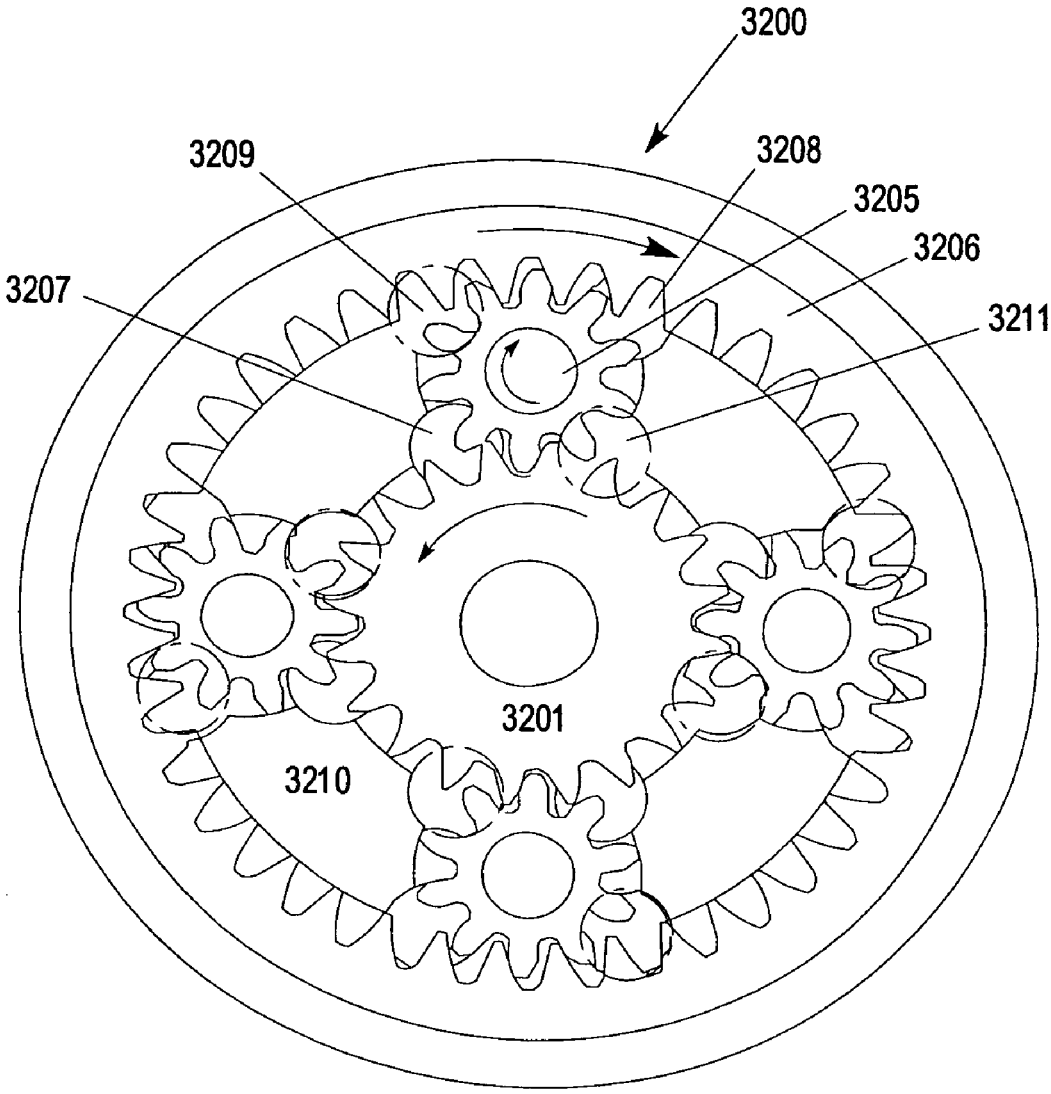
FIG. 32 is a schematic top plan view of another exemplary embodiment of planetary gear pump having certain features and advantages according to the present invention.
Figure 33:
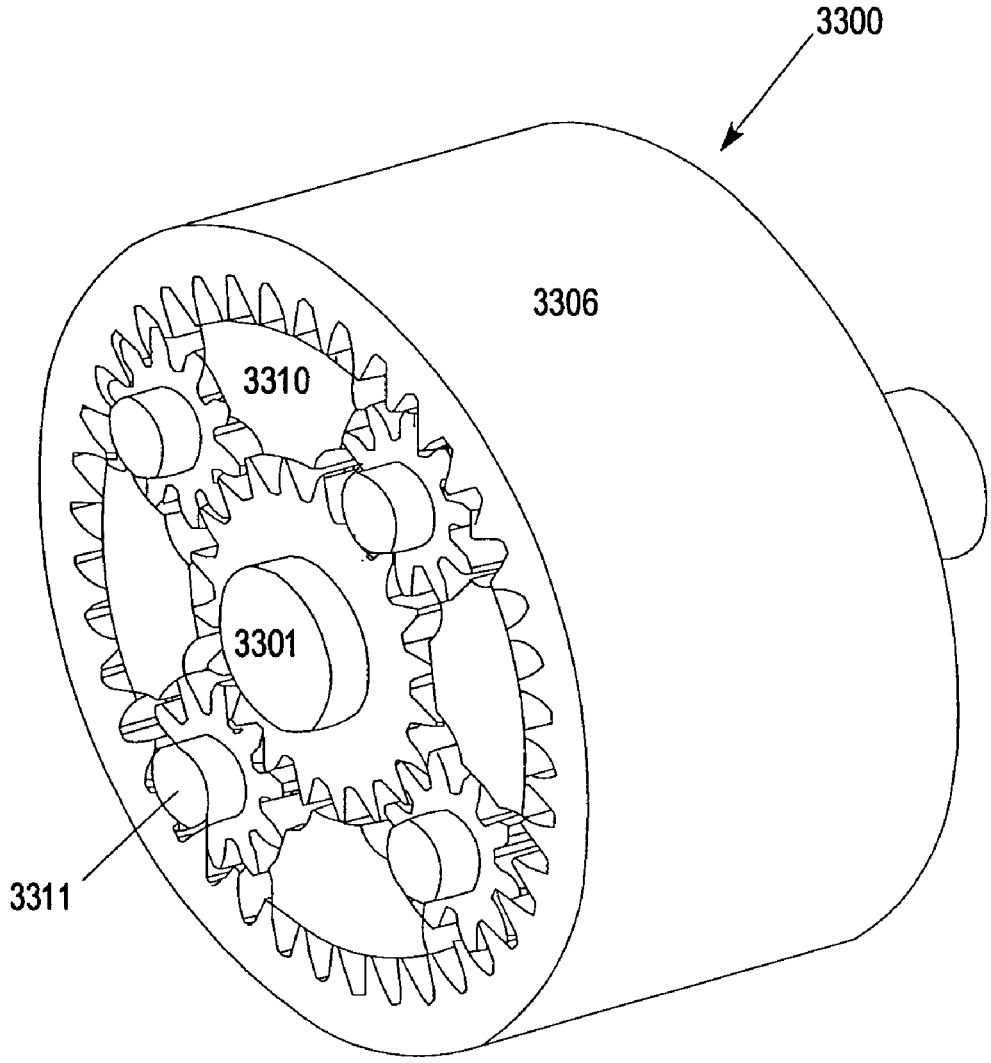
FIG. 33 is a side perspective view of the gear pump of FIG. 32.

It should be noted that it may be beneficial to have a non-staggered effect in some configurations. An example embodiment of such a pump is illustrated in FIG. 32 and FIG. 33 and will be described in more detail below. A non staggered effect may have the advantage of causing any pressure variations or pressure spikes to act in all directions equally at the same time providing a more balanced force on all pump components.

Figure 22:
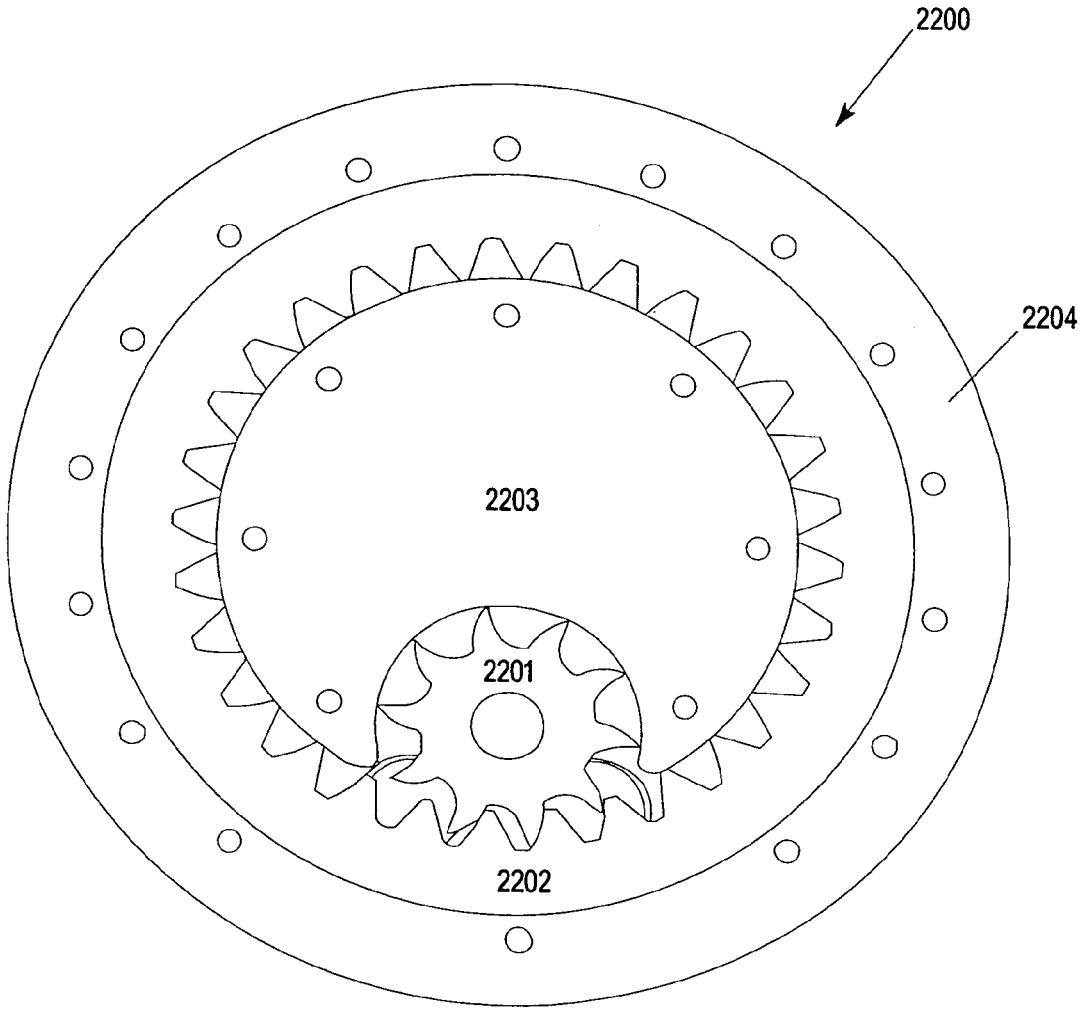
FIG. 22 is a schematic top plan view of exemplary embodiment of an internal gear pump having certain features and advantages according to the present invention.
Figure 23:
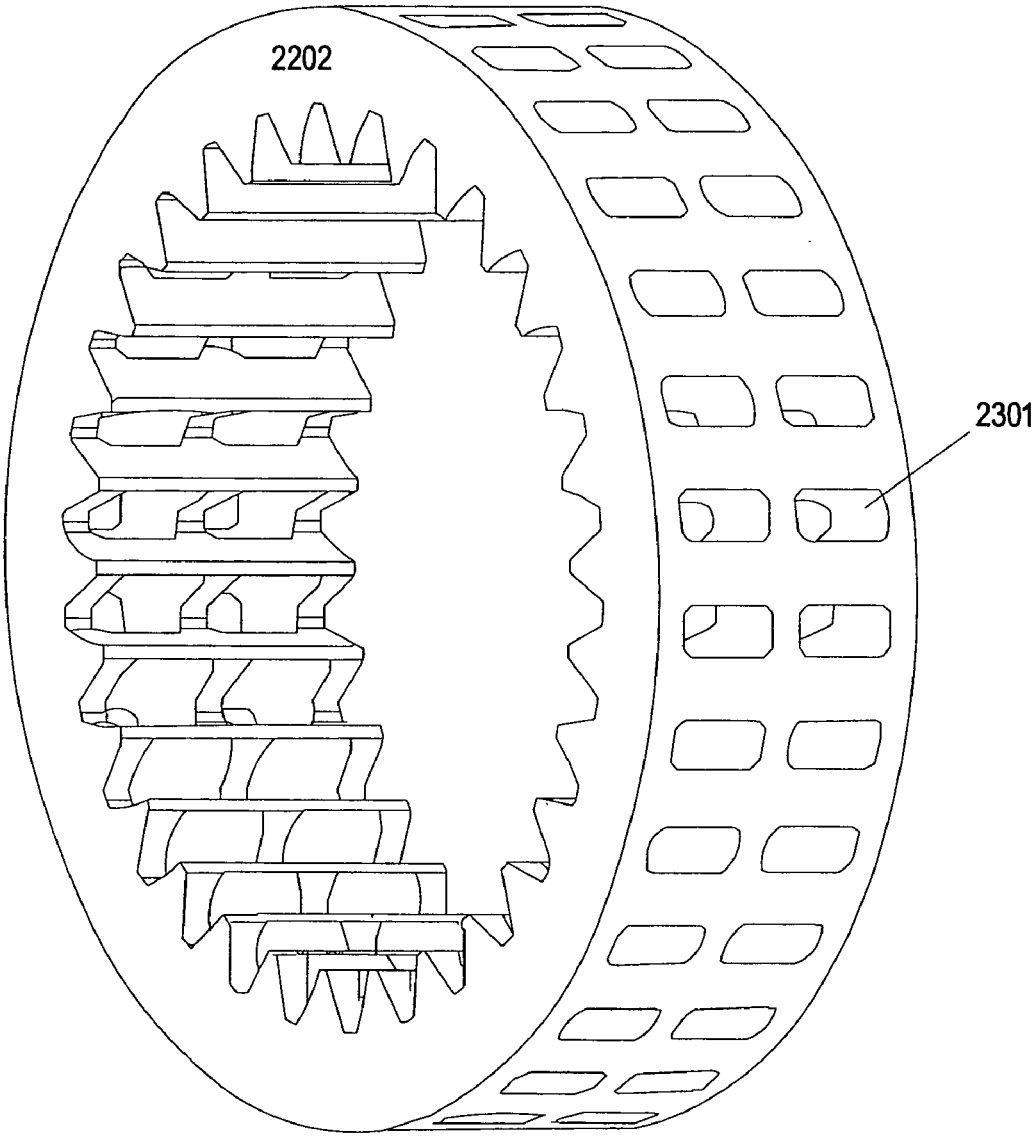
FIG. 23 is a side perspective view of an exemplary embodiment of a rotor of the internal gear pump of FIG. 22.
Figure 24:
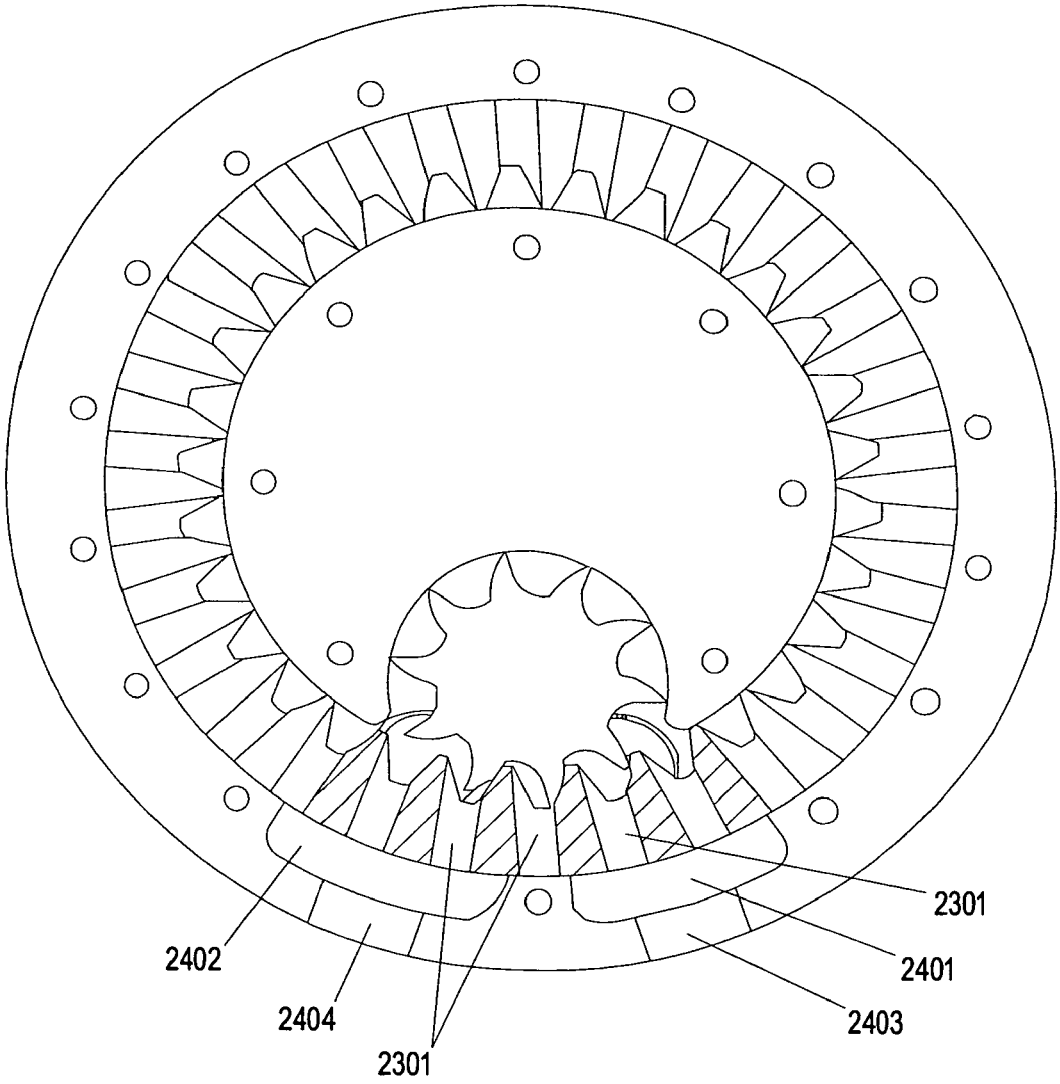
FIG. 24 is a schematic top plan view of the pump of FIG. 22 showing additional features of the design.

FIG. 22 shows an exemplary embodiment of an internal gear pump 2200, which includes an internal gear 2201, an outer gear 2002 a inner casing 2203 and an outer casing 2204. In this embodiment, the internal gear 2201 may be provided with less than half the teeth of the outer gear 2202. FIG. 23 shows the outer rotor 2202 of the pump in FIG. 22 with an example of radial "rotor ports" which, as is known in the art, allow the fluid to flow radially through the rotor 2202. FIG. 24 is a cross section of the assembled pump of FIG. 22 showing the alignment of the outer rotor ports 2301 with radial perimeter port recesses 2401, 2402 and the radial perimeter ports 2403, 2404, which are provided in the outer casing 2204. The radial perimeter port recesses 2401, 2402 have a dwell angle of approximately 1 degree.

Figure 25:
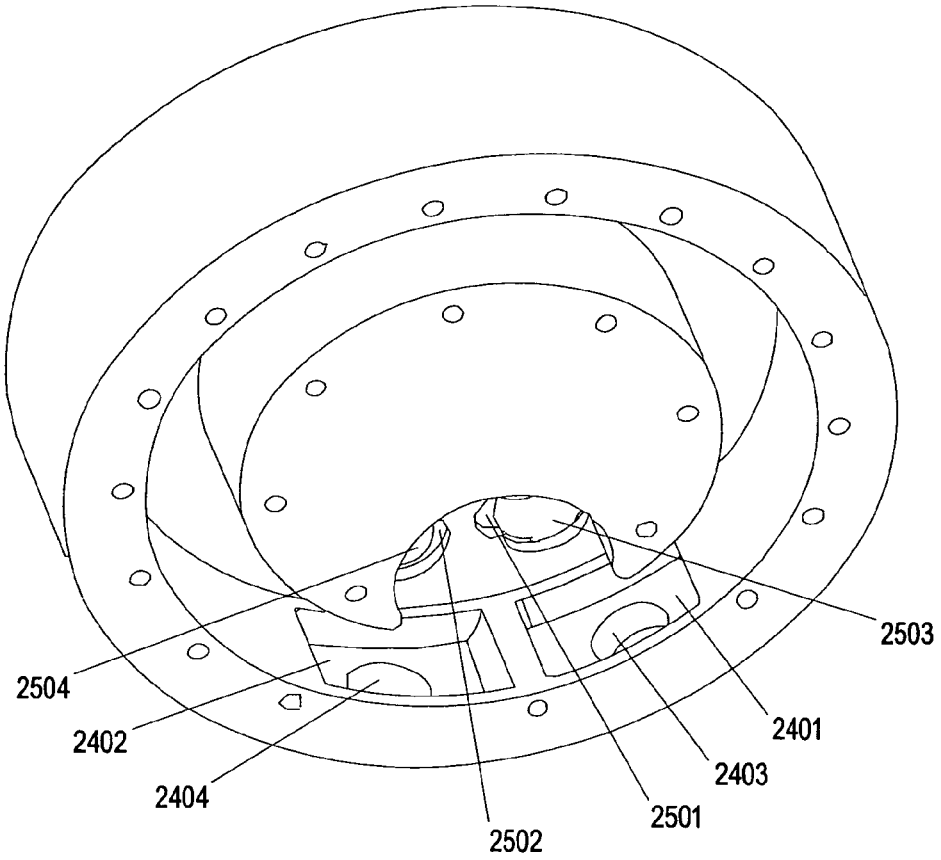
FIG. 25 is a side perspective view of an exemplary embodiment of a casing of the internal gear pump of FIG. 22.

FIG. 25 shows the casing for the pump in 2200 described above with axial port recesses 2501, 2502, axial ports 2503, 2504, radial perimeter port recesses 2401, 2402 and the radial perimeter ports 2403, 2404. Both types of ports and port recesses or a combination of these port and port recesses may be used together depending on the requirements of the application.

Figure 26:
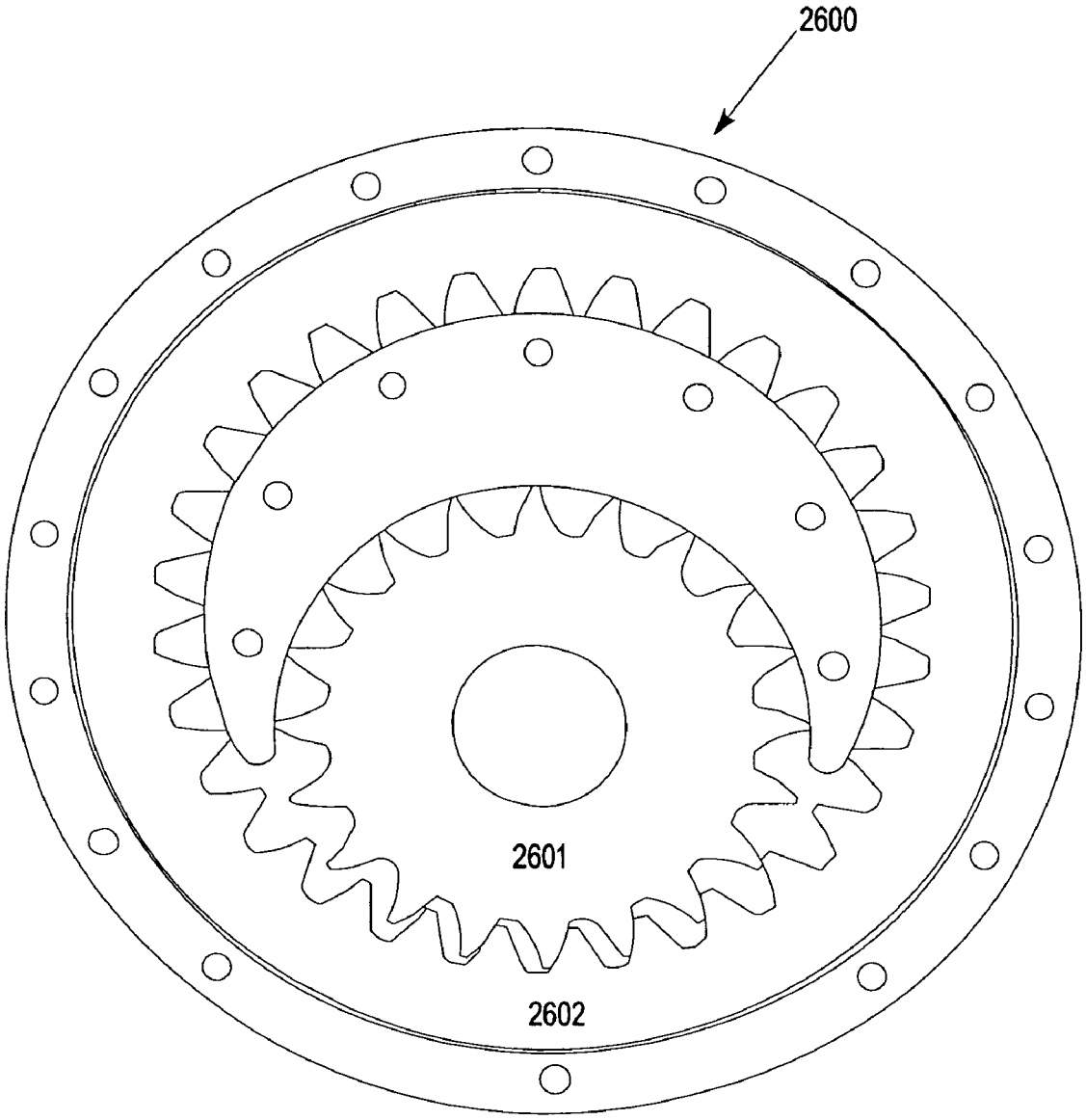
FIG. 26 is a schematic top plan view of another exemplary embodiment of an internal gear pump having certain features and advantages according to the present invention.

FIG. 26 shows an exemplary embodiment of an internal pump 2600 that is similar to the previous embodiment. However, in this embodiment, the pump 2600 includes an inner rotor 2601 with more than half as many teeth as the outer rotor 2602. For simplicity, no ports or port recesses are shown in FIG. 26.

Figure 27:
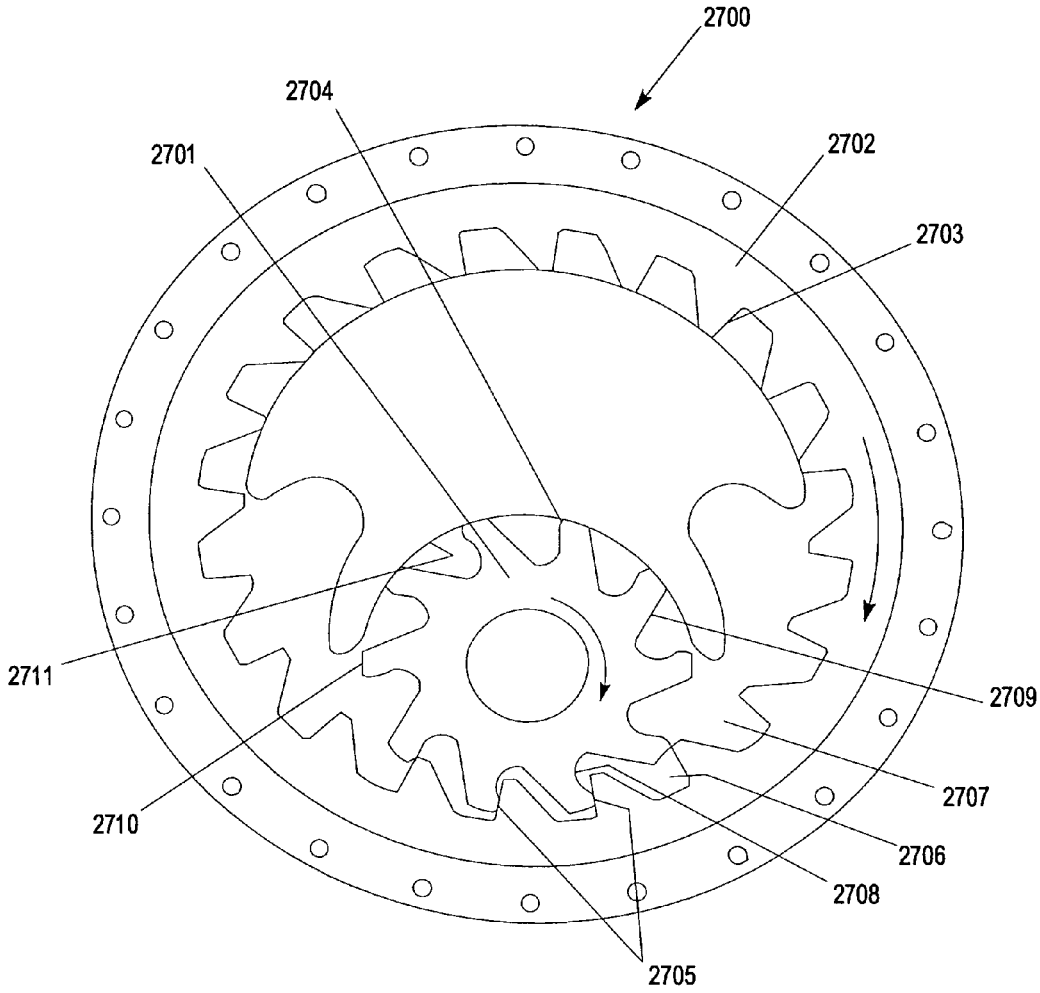
FIG. 27 is a schematic top plan view of another exemplary embodiment of an internal gear pump having certain features and advantages according to the present invention.
Figure 43:
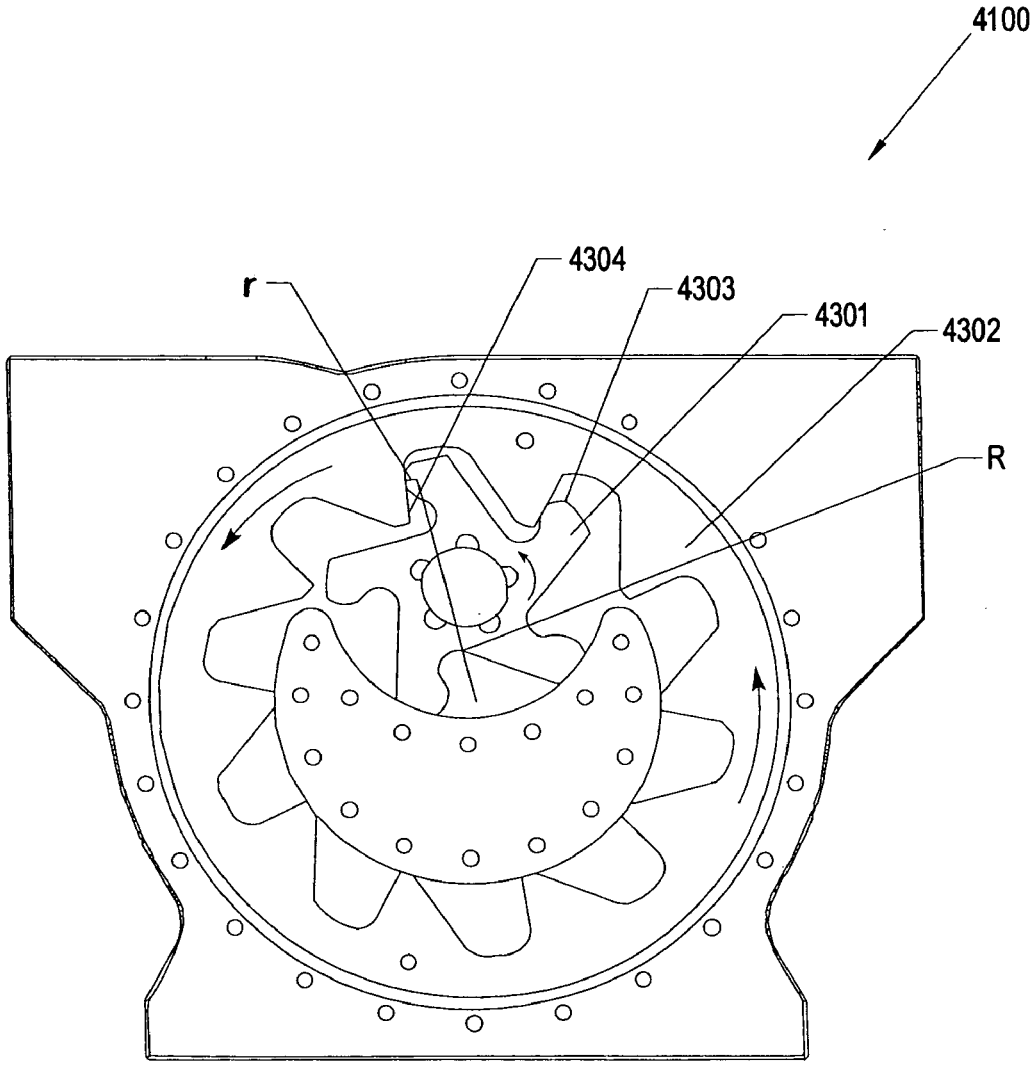
FIG. 43 is a top plan view of the pump of FIG. 41 with a top cover removed.
Figure 44:
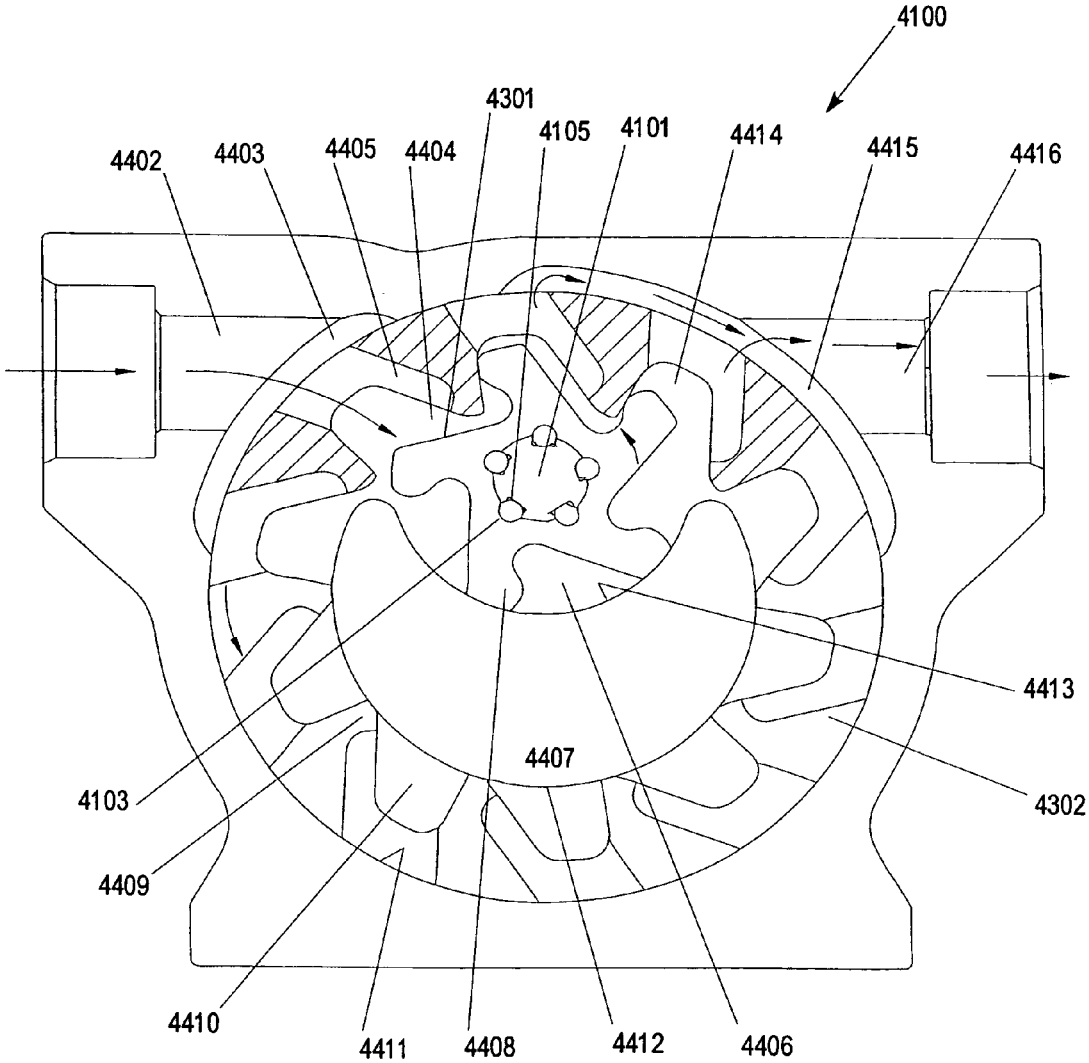
FIG. 44 is a partial cross-sectional view of the pump of FIG. 41.

FIG. 27 illustrates another exemplary embodiment of an internal gear pump 2700. In this embodiment, the inner driven gear 2701 has half as many teeth as the outer drive rotor 2702. With this 2:1 tooth ratio, a unique seal surface interface shape is possible. The outer rotor seal face 2703 is a flat surface which is offset from a radial line from the rotational center of the outer rotor 2702 by the radius dimension of the arc seal surface 2704 of the inner rotor 2701. (see FIG. 43, dimensions labeled R and r)

As mentioned above, there are many different conventional and unconventional gear tooth shapes that could be used with the embodiments described above. Such configurations include the gear tooth shapes in FIG. 27, helical gear shapes and bevel gears etc. When using such conventional and unconventional gear shapes, due consideration should be given to a principles of the present invention as described above. For example, the chamber, which is established between the teeth as they mesh, is preferably defined by the leading faces only of the driving rotor and the trailing faces only of the driven rotors. In the case of a multi-rotor design such as the exemplary planetary gear pump 3200, 3300 shown in FIG. 32 and FIG. 33 (described in more detail below), driven planet gears 3205, 3311 also act as driving gears against a ring gear 3206, 3306. In such an embodiment, both the leading and trailing face are used as sealing faces at the same time but on different meshing gears.

It is understood that these drawings are simplified and do not contain detailed information about how the rotors are supported by shafts or bearings or fluid film bearing effects with the casing or engaging rotors. However, in light of the teachings of the present application, such features can be readily determined by one of skill in the art given through routine experimentation or modeling. For example, the gap clearance between the two rotors, and between the rotors and the casing is also not specified but could be anywhere from a contact fit to lesser or greater than 0.005". It is believed by the inventor that a gap clearance of 0.0005" to 0.005" is the range that will be useful for a wide range of applications. A gap clearance of approximately 0.003" has been tested with SAE 30 weight oil with very good pressure capability and very good volumetric efficiency.

Several things must be considered when determining which rotor is to drive and which rotor is to be driven in an internal rotor configuration. Specifically, the displacement of the pump will be increased if the outer rotor is driven. Another consideration is that the drive must be in the opposite direction if the outer rotor is used to drive the pump rather than the inside rotor unless the rotor teeth are designed to be reversible.

An aspect of the present inventions is the prevention or reduction of wear in abrasive or high pressure or other applications by the "contact force reduction" of the sealing surfaces if the outer rotor drives the inner rotor. This effect is most easily illustrated in the example configuration in FIG. 27. To achieve this "contact force reduction" effect, the outer drive rotor 2702 is driven clockwise in this embodiment which in turn causes the inner driven rotor 2701 to turn clockwise as well by the contact points 2705. Any hydraulic pressure that results in the areas 2706 and 2707 will act on the inner rotor in the clockwise direction against the trailing face 2708 of the inner rotor 2701 and in the counter clockwise direction against the leading face 2709. As a result of the greater area of the leading surface 2709 being exposed to the discharge pressure as compared to the trailing surface 2708, the total rotational force which will result from the hydraulic discharge pressure will be in the counterclockwise direction on the inner rotor 2701 but only by the difference between the two surfaces 2709 and 2708. This difference is very slight and therefore, the contact pressure which results from the rotational force of the inner rotor 2701 seal surface 2704 against the outer rotor 2702 seal surfaces 2703 is much less than if the inner rotor is used to drive the outer rotor.

The contact force that results from driving the outer rotor 2702 will ideally be large enough to establish a satisfactory seal, but small enough to establish a fluid film between the seal surfaces. This contact force is adjustable by increasing or decreasing the diameter of the inner rotor largest diameter surface 2710 as well as the interior casing seal surface 2711. This changes the difference between the leading surface 2709 and the trailing surface 2708 which are exposed to the discharge pressure.

Figure 28:
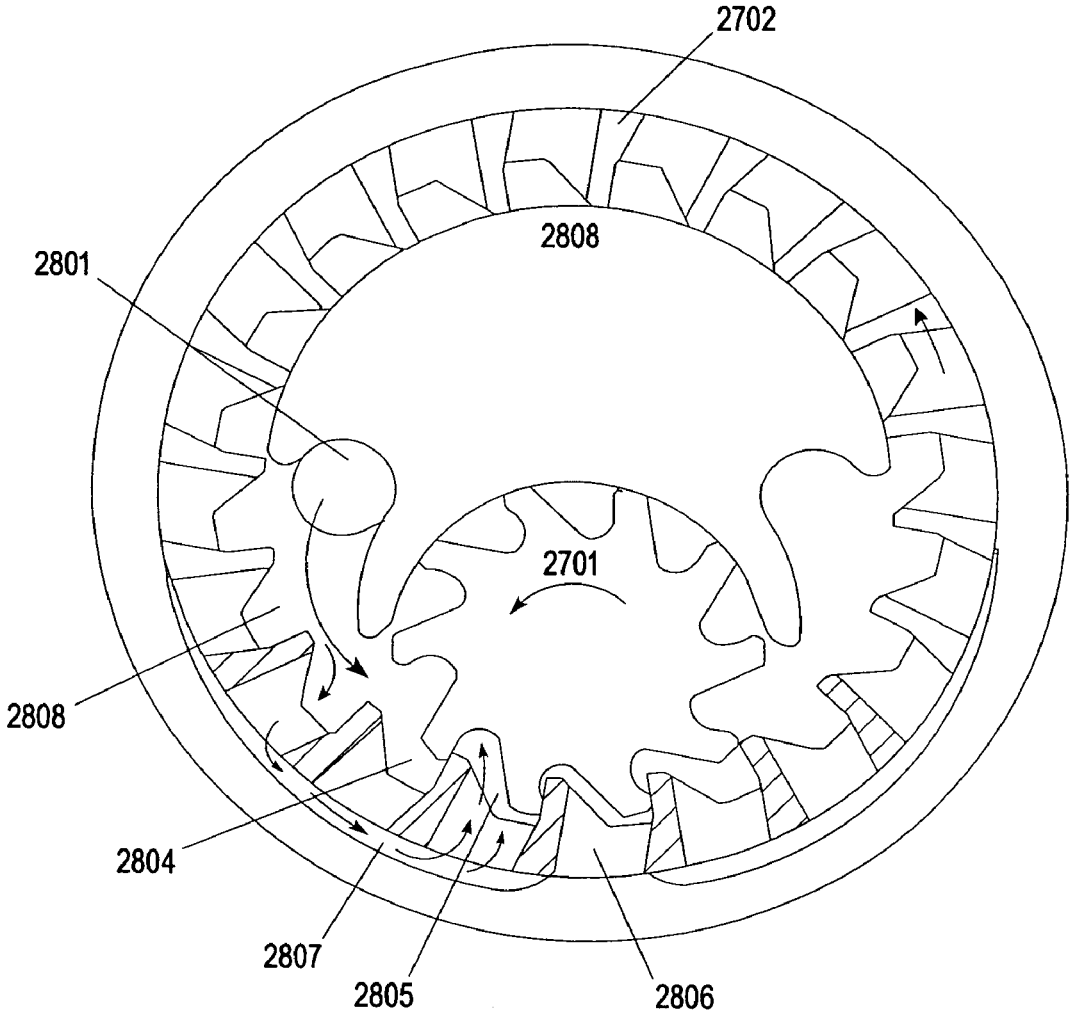
FIG. 28 is a schematic top plan view of modified embodiment of an internal gear pump of FIG. 27.
Figure 29:
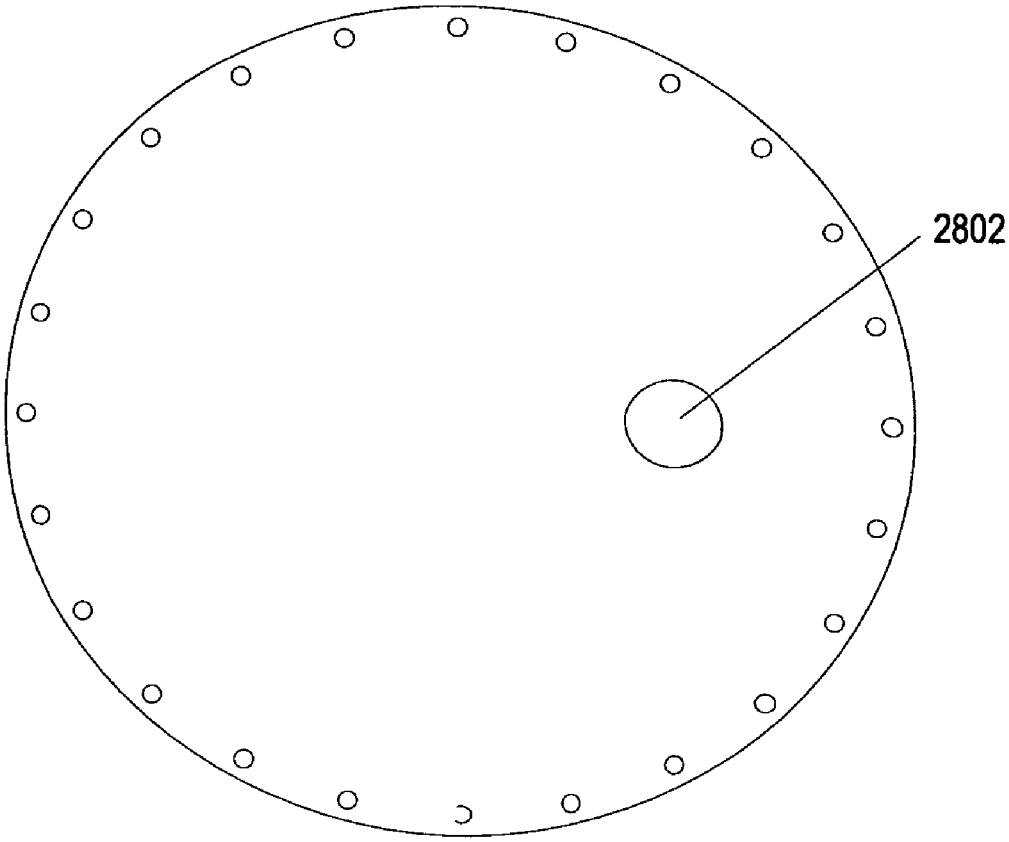
FIG. 29 is a schematic top plan view of exemplary embodiment of a top plate that may be used with the embodiments of FIGS. 27 and 28.

FIG. 28 is a cross sectional view of an example of a unique port configuration which could be used on any of the internal gear pumps described herein. The advantage of this port configuration includes movement of intake fluid through an axial port 2801 and the discharge fluid through an discharge axial port 2802 (FIG. 29). This port arrangement allows the ports 2801, 2802 to be aligned at 180 degrees to each other in the inner casing seal member 2803. This has advantages for access restricted and size restricted applications such as down-hole pumps for water or oil. Another advantage of this configuration is the ability to stack the pump rotors in series stages to increase pressure capability by stacking the stages at 180 degrees to each other. The pump stages could also be stacked in parallel to increase flow volume by stacking the stages in the same position in line with each other. A combination of parallel and series stages could be implemented to achieve both increased pressure and increased flow.

The example configuration in FIG. 28 is a single stage which draws fluid in through the axial intake port 2801 and then through the radial inlet conduit 2808 to the rotor disengagement area 2804. The expanding chamber 2805 is sealed from the rotor disengagement area 2804 so it is necessary to provide an alternate path for the fluid to flow into this area. In the example embodiment of FIG. 28, radial rotor ports 2806 allow fluid to flow from the perimeter port recesses 2807 which are supplied by fluid from the radial intake conduit 2803 through the radial rotor ports 2806. The fluid goes through the reverse cycle on the discharge side of the pump where it is discharged out the port 2802 (FIG. 29). Axial port recesses could also be used in this configuration to further reduce fluid flow resistance but are not shown in FIG. 28.

Figure 30:
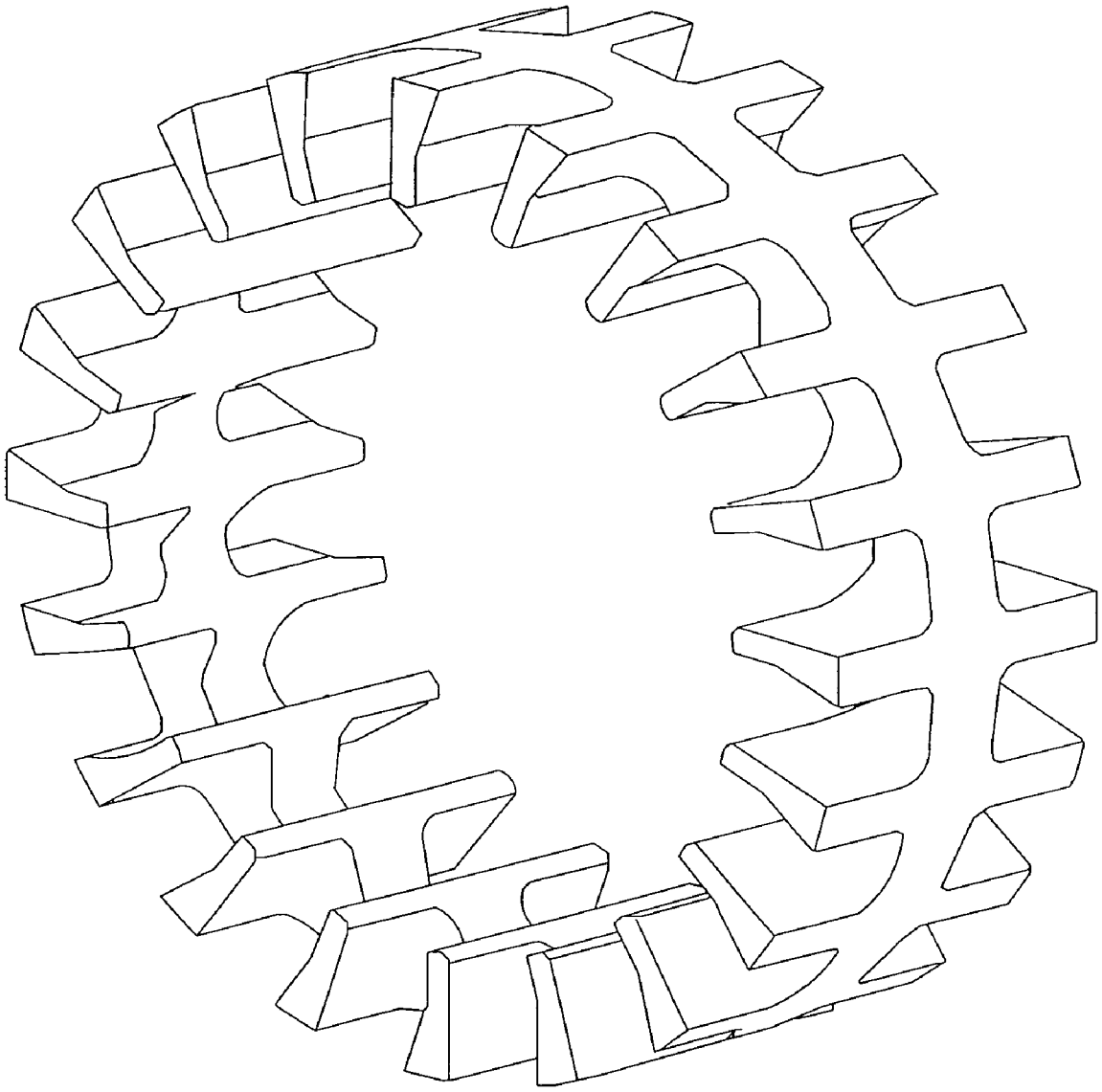
FIG. 30 is side perspective view of exemplary embodiment of an outer rotor that may be used with the embodiments of FIGS. 27 and 28.
Figure 31:
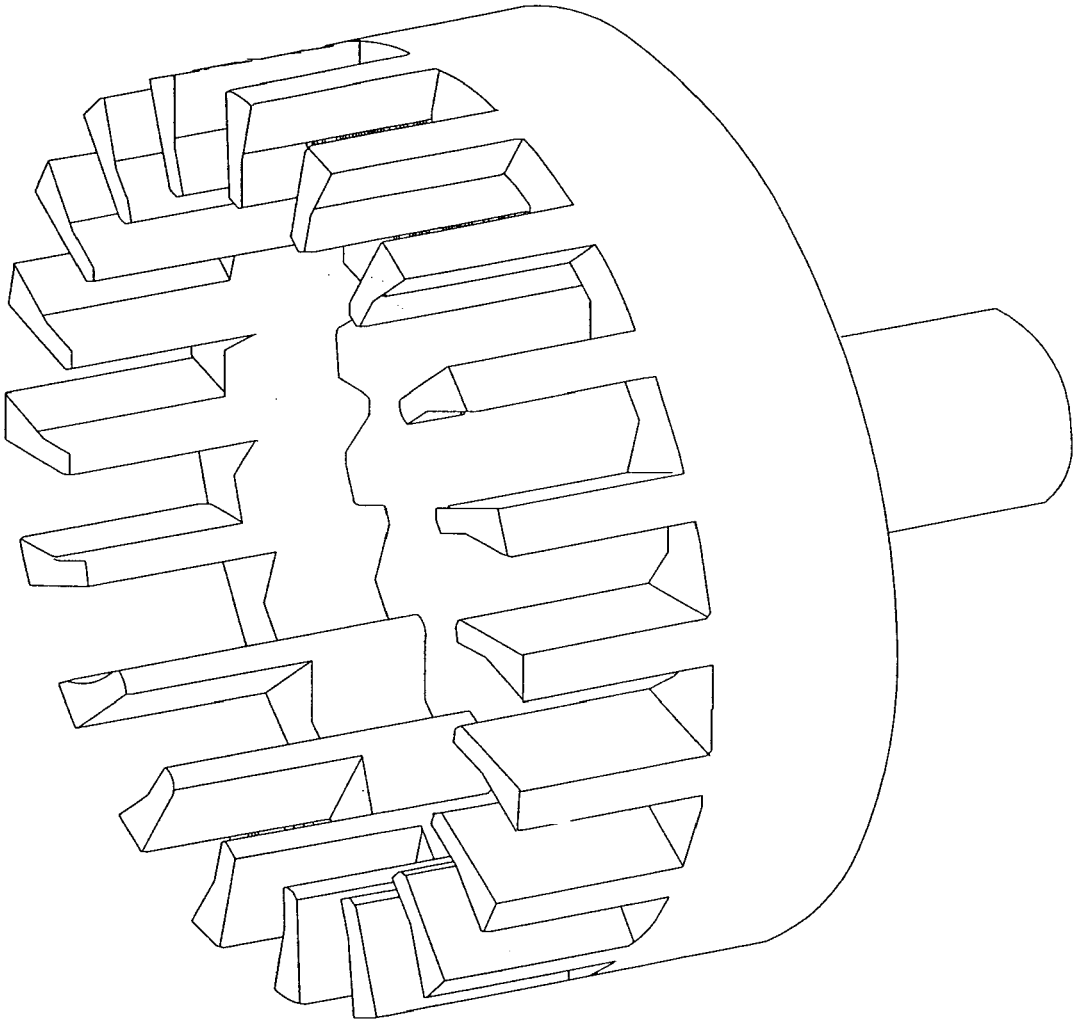
FIG. 31 is a side perspective view of the rotor of FIG. 30 attached to a drive shaft.

An outer rotor with radial rotor ports with a simplified manufacturing design is shown in FIG. 30. This outer rotor would have to be driven by the inner rotor. A simplified manufacturing design of an outer rotor which can be mounted to a drive shaft is shown in FIG. 31. This rotor design has manufacturing advantages by will not be capable of as high pressures or speeds as some of the other configurations described in this patent description.

FIG. 32 shows an exemplary planetary gear pump having certain features and advantages according to the present invention. In this example embodiment, the inner rotor 3201 drives the planet gears 3205 which, in turn, drive the ring gear 3206. The fluid is drawn into the pump through the intake ports 3207, 3208 in and then discharged from the pump through the discharge ports 3209, 3211 in the upper casing (not shown) represented by the dashed lines. As mentioned above, there are many possible variations of this and other pump embodiments that can be achieved using the teachings of this patent application. For example, different sizes of rotors, different numbers of rotors, different gear face shapes, different port and casing configurations may be integrated into the configurations described herein. It should be appreciated that the example embodiment in FIG. 32 does not show any axial port recesses for simplicity of the drawing, but the round axial ports approximate the ideal shape of the axial ports and should therefore be acceptable for some applications. The inner driving gear 3201 and outer ring gear 3206 are single direction configurations as in FIG. 2 while the planet gears are of a reversible design with increased backlash as in FIG. 8. Only the planet gears 3205 need to be of a reversible shape in this embodiment because the opposite side of the gear teeth are in contact with the inner rotor 3201 as they are with the outer rotor 3206.

FIG. 33 shows a variation of this example embodiment which uses a stationary ring gear 3306 and a rotating inner casing/planet gear carrier 3310. Advantages of this configuration may include a reduced outer diameter as the ring gear 3306 could serve as the outer casing. Also, by allowing the inner casing/planet gear carrier 3310 to rotate freely, the radial load on the planet gears 3311 may reduce the side load on the bearings and shafts of the planet gears and allow the use of abrasive resistance sleeve bearings which would not need to be sealed from the fluids and which would have reduced wear due to the reduced load. The inner gear 3301 is used to drive the pump in FIG. 33.

Figure 34:
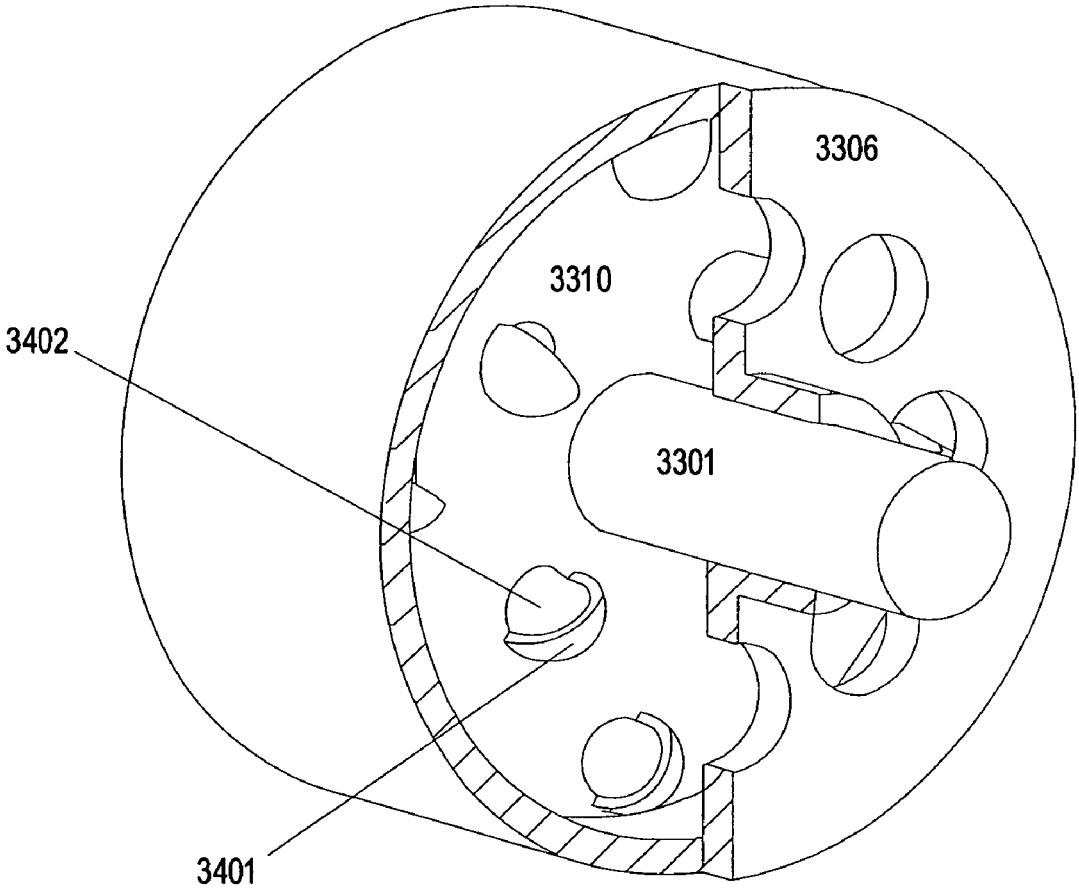
FIG. 34 is a partial cross-sectional view of the gear pump of FIG. 32.

In FIG. 34 the inlet ports which are located in the spinning inner casing/planet carrier 3310 could use inertia charge conduits 3401 on the inlet ports 3402 to increase the inlet charge pressure to avoid cavitation at higher speeds or with higher viscosity fluids.

With respect to the embodiment described above, planetary gear tooth profiles can be a challenge to designers because the ideal planet tooth shape will be different for the ring gear than it will be for the sun gear. The relationship of the planet gear to the ring gear is of an internal gear set. The relationship of the planet gear to the sun gear is of an external gear set.

In one embodiment, for a single direction planetary gear pump such as for a down hole pump, a planet gear tooth shape on the leading edge which is ideally shaped to engage with the ring gear can be used with a gear tooth shape on the trailing edge of the planet gears which is ideally shaped to engage with the sun gear. When combined with the sufficient backlash designs described above, a pump design can be simplified and the manufacturing cost reduced. Unconventional gear tooth shapes can also be used in this asymmetric planet gear tooth profile configuration, but with this configuration, conventional gear tooth profiles and manufacturing processes can be utilized to create pump rotors. This configuration will operate in reverse but may not provide as an ideal seal as when operated in the forward direction.

Figure 35:
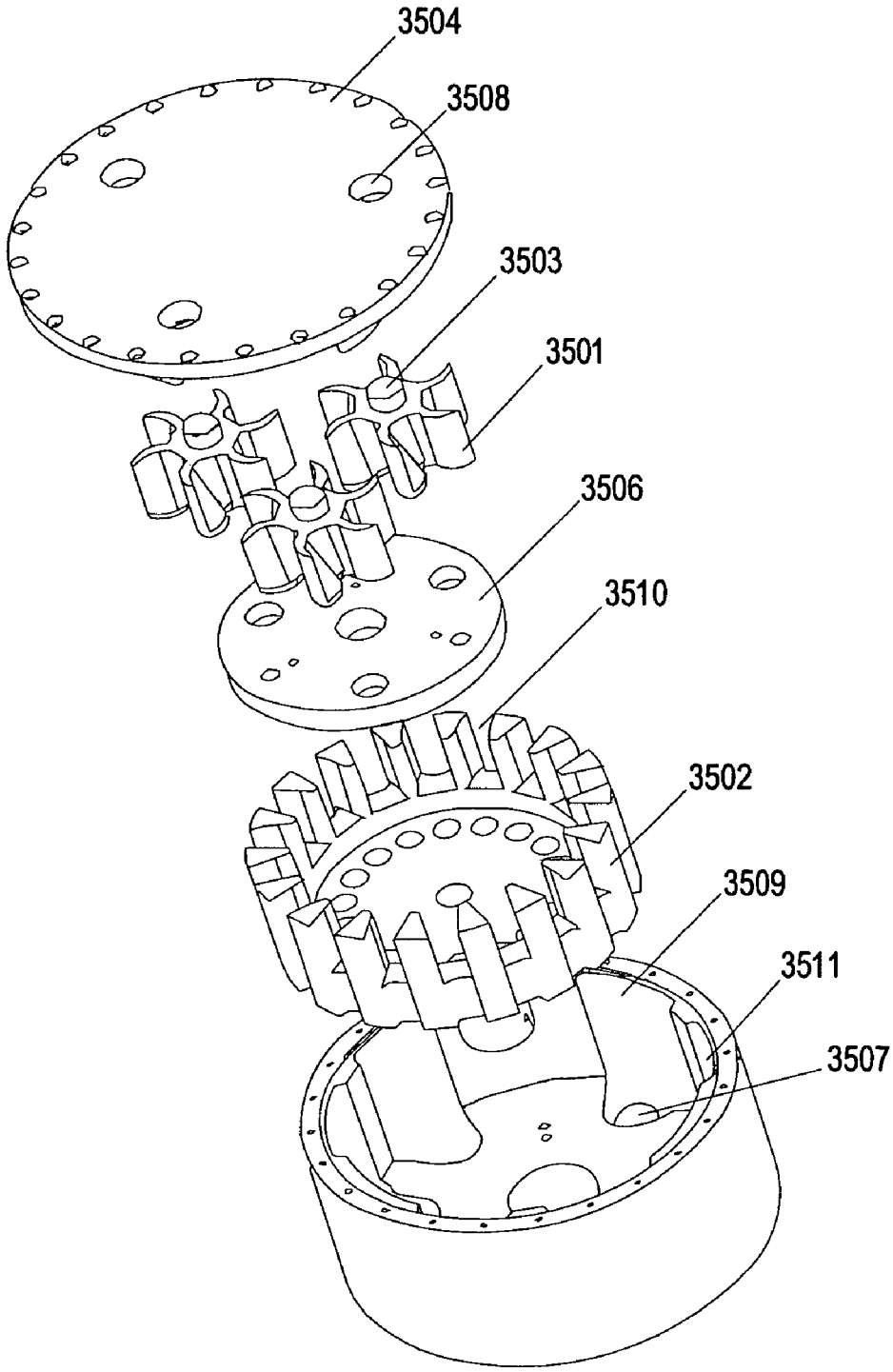
FIG. 35 is an exploded side view of another exemplary embodiment of planetary gear pump having certain features and advantages according to the present invention.
Figure 36:
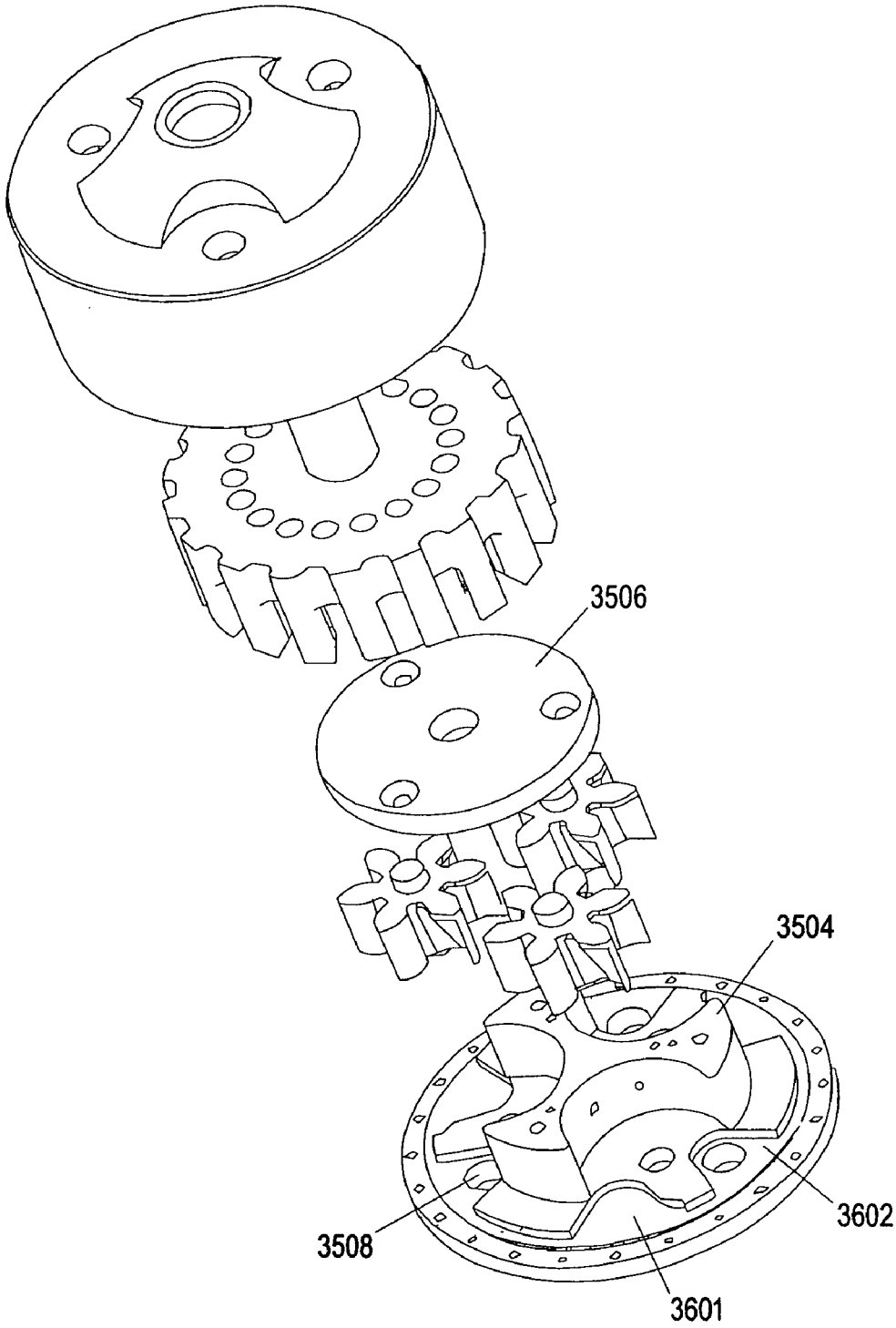
FIG. 36 is another exploded side view of the pump of FIG. 35.
Figure 37:
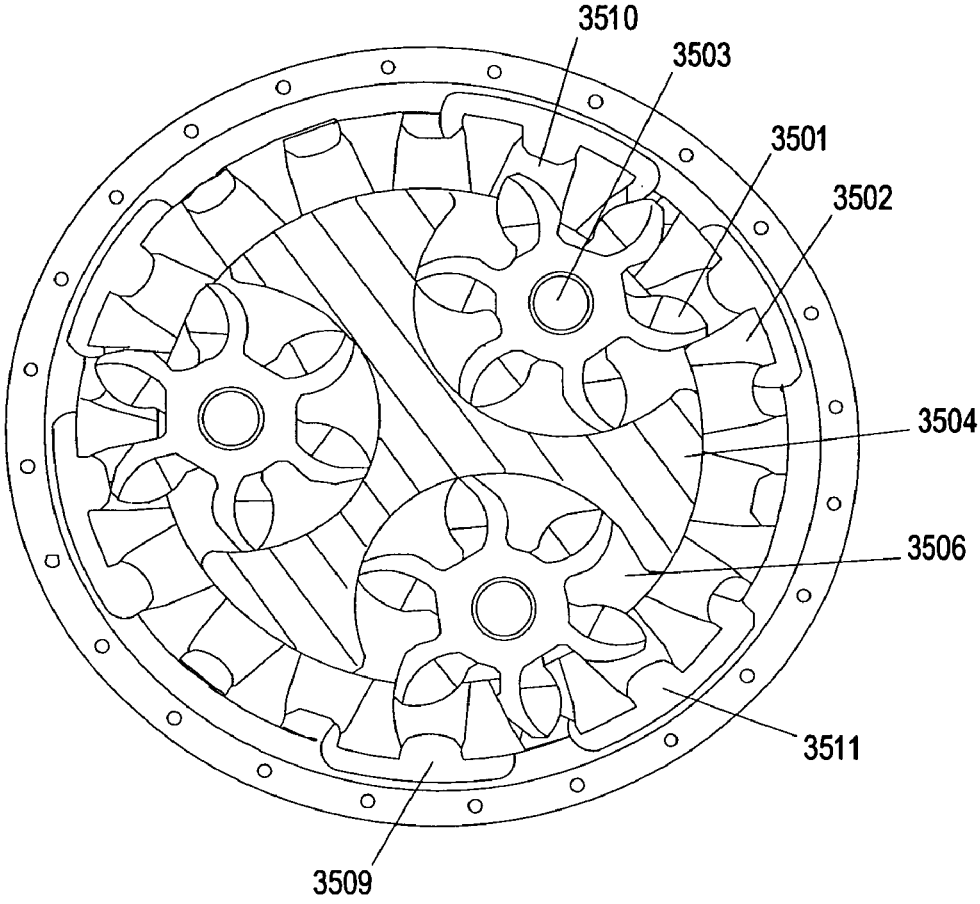
FIG. 37 is a top plan view of the pump of FIG. 35.

FIG. 35 and FIG. 36 show exploded views and FIG. 37 shows a front cross section view of a three inner rotor 3501 pump using the unconventional gear tooth shape as shown in FIG. 16*c*. In this configuration, the outer rotor 3502 is the drive rotor. The shafts 3503 of the inner rotors 3501 are held between the cover 3504 and the cover plate 3506. The fluid enters and exits the pump through the axial inlet ports 3507 which provide fluid to the radial casing inlet port recesses 3509. The radial casing inlet port recesses 3509 supply fluid to the outer rotor radial rotor ports 3510 and to the axial port recesses 3601 in the casing cover 5304 (FIG. 36). The fluid is discharged through the axial discharge port recesses 3602, the outer rotor radial rotor ports 3510, and the radial casing discharge port recesses 3511, and finally out through the axial discharge ports 3508.

Figure 38:
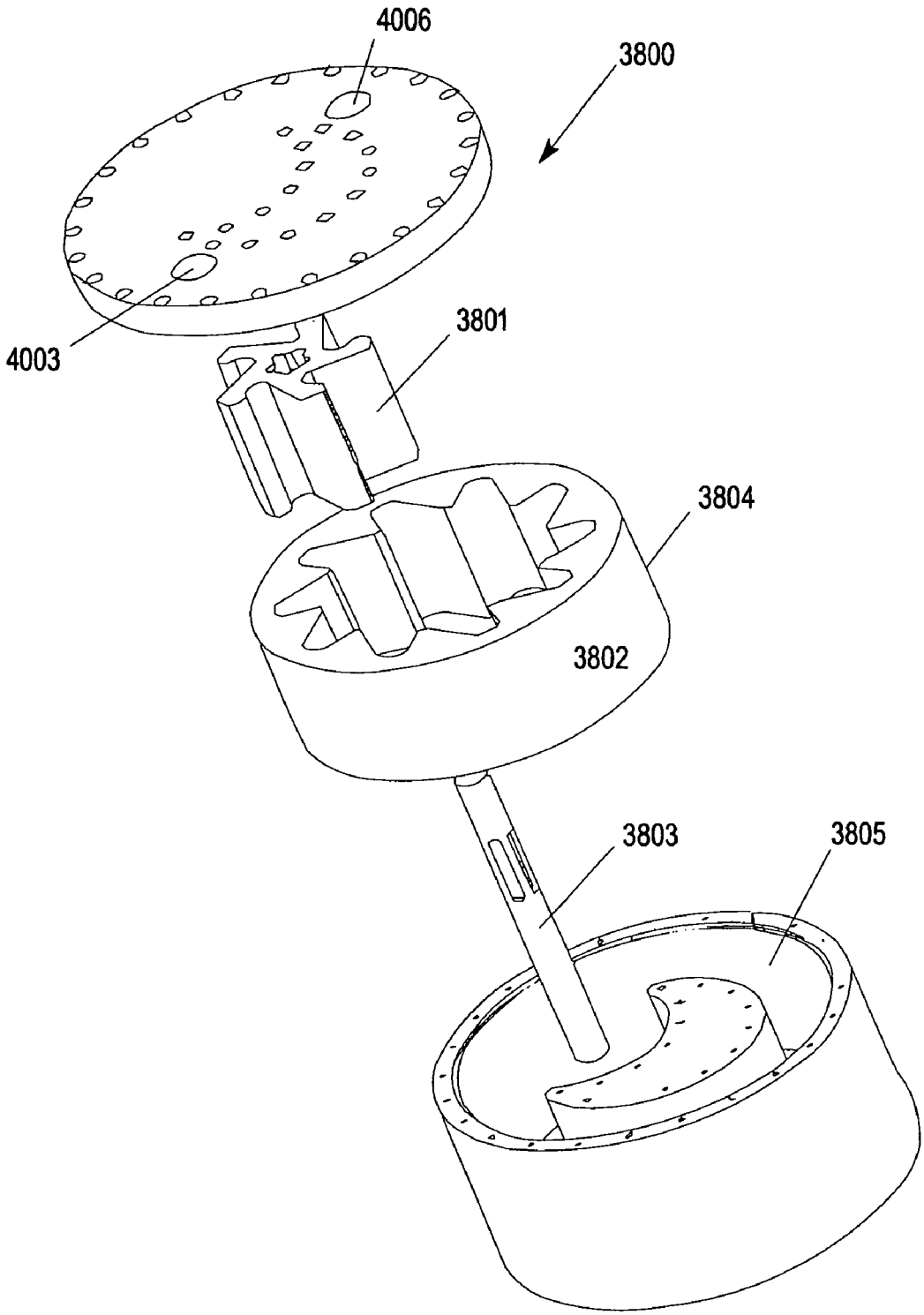
FIG. 38 is an exploded side view of another exemplary embodiment of internal gear pump having certain features and advantages according to the present invention.
Figure 39:
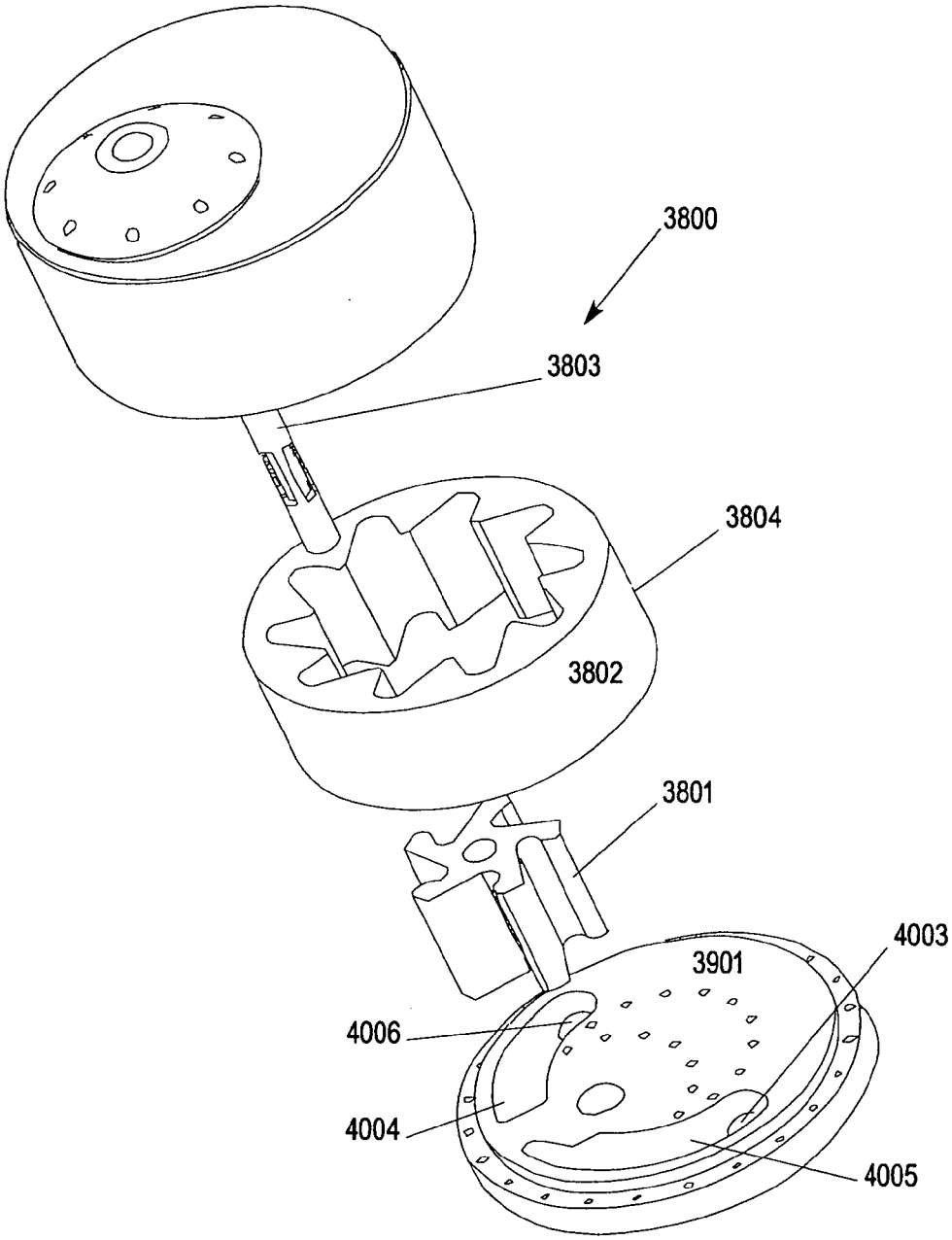
FIG. 39 is another exploded side view of the pump of FIG. 38.
Figure 40:
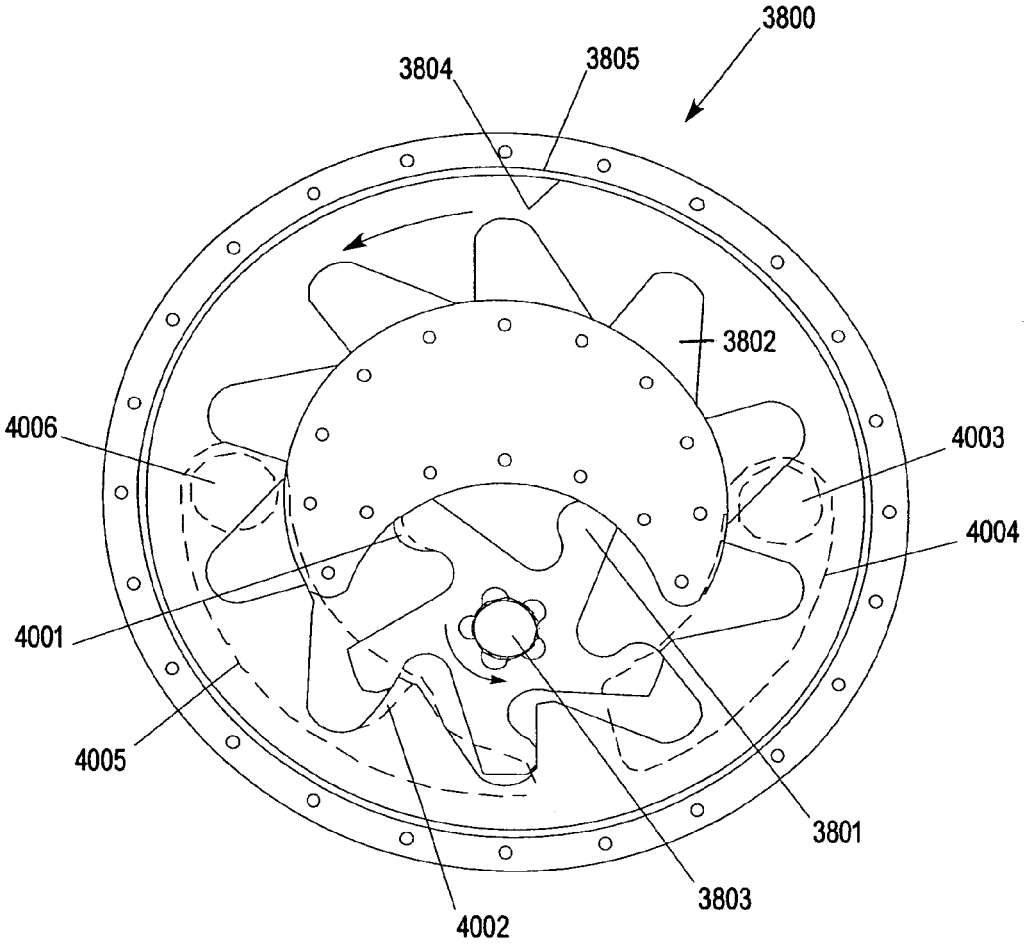
FIG. 40 is a top plan view of the pump of FIG. 38.
Figure 41:
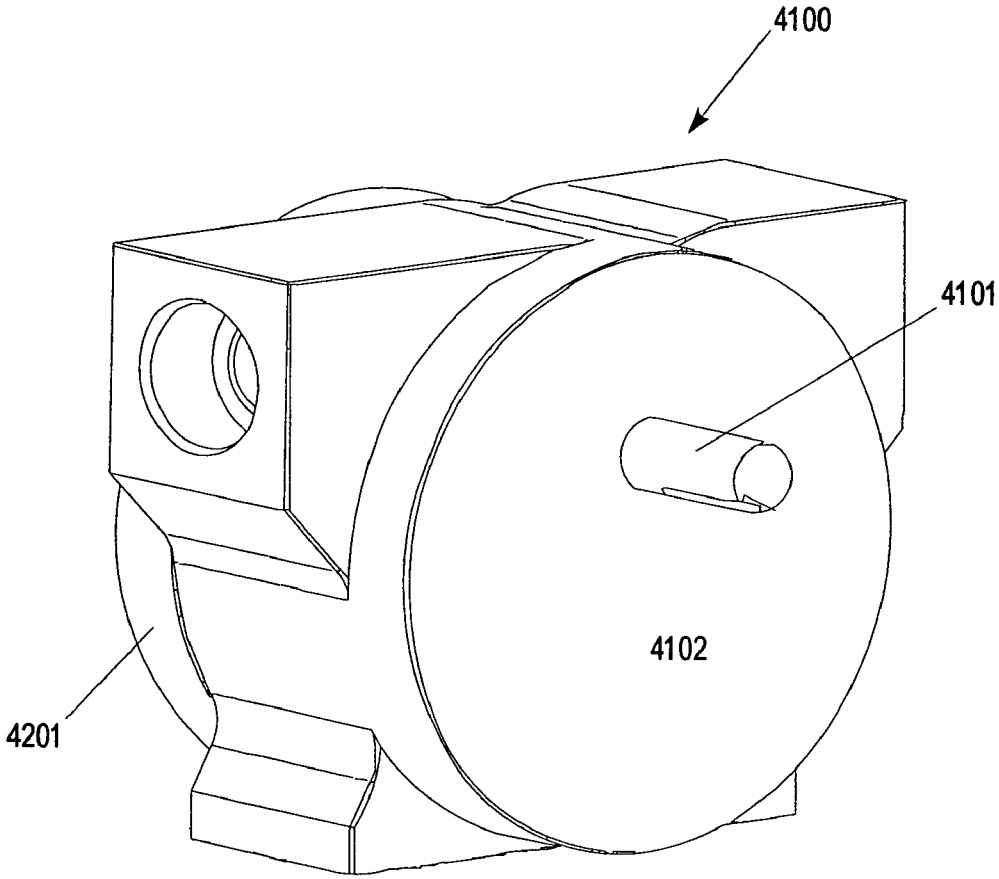
FIG. 41 is an side perspective view of another exemplary embodiment of an internal gear pump having certain features and advantages according to the present invention.
Figure 42:
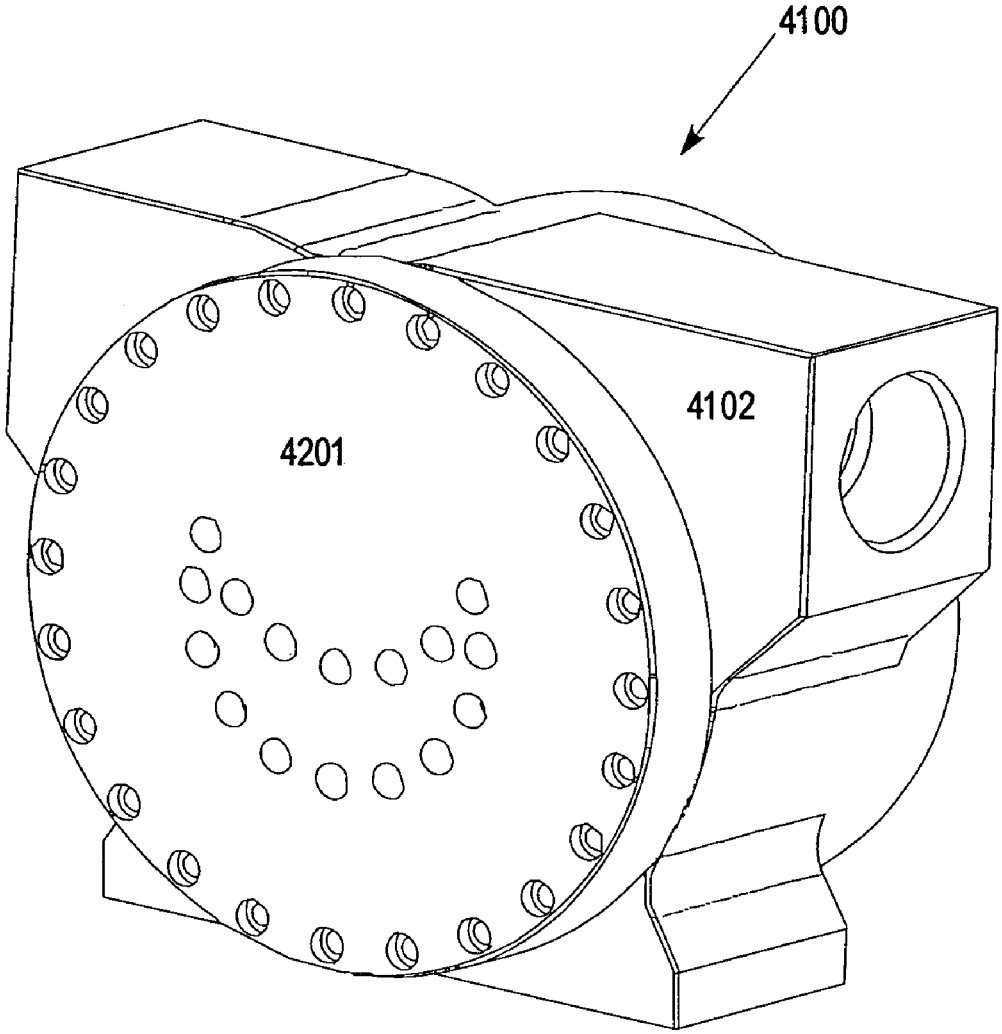
FIG. 42 is another side view of the pump of FIG. 41.

FIG. 38 through FIG. 40 show an exemplary embodiment of an internal gear pump 3800 having certain features and advantages according to the present invention. This pump 3800 has a gear tooth configuration similar to that of FIG. 27. This example embodiment uses the inner gear 3801 as the drive gear and the outer gear 3802 as the driven gear. It should be noted that significant material can be worn off the seal face 4001 of the inner rotor 3801 (FIG. 40) and the seal face 4002 of the outer rotor 3802 (FIG. 40) Fluid is drawn into this embodiment through the intake axial port 4003 (shown in dashed lines in FIG. 40) in the casing cover 3901 (not shown in FIG. 40) and the axial inlet port recess 4004. Fluid is discharged from the pump through the axial inlet port 4005 and finally out through the axial discharge port 4006. The inner rotor 3801 is supported and driven by the inner rotor shaft 3803. The outer rotor 3802 in this example embodiment is supported by a fluid film bearing effect between the outer rotor outer surface 3804 and the casing inner surface 3805.

FIG. 41 through FIG. 44 show a preferred embodiment of a pump 4100 having certain features and advantages according to the present invention. This embodiment has advantageously reduced manufacturing and design costs, while still producing excellent pressure capability and high volume output. In addition, both rotors 4301, 4302 can experience significant wear and still maintain a seal between the two rotor seal surfaces 4303, 4304. The inner rotor 4301 is driven by the inner rotor drive shaft 4101 which is rotationally supported by a bearing in the casing cover 4201 and the casing 4102. Torque is transferred from the shaft 4101 to the inner rotor 4301 by the drive shaft keyways 4105 and the drive dowels 4103.

Fluid is drawn into the pump through the radial port 4402 into the radial casing port recess 4403. The fluid is then drawn into the rotor disengagement area 4404 through the outer rotor radial rotor ports 4405. The fluid then travels in the chamber 4406 between the inner rotor teeth 4408 and the inner casing seal member 4407 and inner surface 4413. Fluid also travels in the chamber 4410 between the outer rotor teeth 4409 and the outer casing inner surface 4411 and the inner casing seal member outer surface 4412. When the fluid reaches the rotor engagement area 4414, it is displaced through the outer rotor radial ports 4405 and then through the casing radial discharge recess 4415 and finally out through the casing radial discharge port 4416.

As the inner rotor seal surface 4303 and/or the outer rotor seal surface 4304 wears, it will advance rotationally relative to the outer rotor 4302.

Although this invention has been disclosed in the context of certain exemplary and preferred embodiments, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

I claim:

1. A pump comprising:

a casing having an inlet port on an inlet side of the pump and a discharge port on a discharge side of the pump;

a driving rotor that is supported for rotation within the casing, the driving rotor having a plurality of teeth, each of the plurality of teeth having a leading convex surface and a trailing surface; and a driven rotor that is supported for rotation within the casing in the same direction as said driving rotor, the driven rotor having a plurality of teeth, each of the plurality of teeth having a leading surface and a trailing flat surface, wherein the driving rotor and the driven rotor are positioned in the casing such that, as the driving rotor and the driven rotor rotate, the teeth of the driving rotor and the teeth of the driven rotor are interfaced with one another to form a seal between the inlet side and the discharge side of the pump, the seal being formed only between the leading convex surfaces of the teeth of the driving rotor and the trailing flat surfaces of the teeth of the driven rotor.

2. The pump as in claim 1, wherein, as the driving rotor and the driven rotor rotate, a positive displacement chamber is formed between the seal, which is formed between the leading convex surface of one of the plurality of teeth of the driving rotor and the trailing flat surface of one of the plurality of teeth of the driven rotor, and a second seal, which is formed between the leading convex surface of a following tooth of the driving rotor and the trailing flat surface of a following tooth of the driven rotor.

3. The pump as in claim 2, wherein the seals are formed between the leading convex and trailing flat surfaces of a pair of adjacent teeth on each of the driving and driven rotors.

4. The pump as in claim 2, wherein the seals of said positive displacement chamber are formed between and by no more than the leading convex and trailing flat surfaces of a single pair of adjacent teeth on each of the driving and driven rotors.

5. The pump as in claim 2, wherein said positive displacement chamber lies in a counterclockwise flow path between the inlet and outlet discharge ports of said pump casing.

6. The pump as in claim 2, wherein the leading convex surfaces of the plurality of teeth of said driving rotor wear down to generally flat surfaces during the rotation of said driving rotor so as to be interfaced with the trailing flat surfaces of the plurality of teeth of said driven rotor to thereby maintain the seals between said positive displacement chamber with substantially no volumetric loss thereof.

7. The pump as in claim 1, wherein there is sufficient space between the trailing surfaces of the plurality of driving rotor teeth and the leading surfaces of the plurality of driven rotor teeth such that no seal is formed therebetween when the teeth of the driving rotor and the teeth of the driven rotor are interfaced with one another.

8. The pump as in claim 1, wherein the driving rotor and the driven rotor have an axial length and the seal extends through the entire axial length of the driving and driven rotors.

9. The pump as in claim 1, wherein the driving rotor and the driven rotor have an axial length and the driving rotor and the driven rotor have an axial relief that extends through a portion of the axial length of the driving and driven rotors.

10. The pump as in claim 1, wherein the trailing face of the driving rotor is at least partially recessed with respect to the leading face of the driving rotor.

11. The pump as in claim 1, wherein the leading face of the driven rotor is at least partially recessed with respect to the trailing face of the driving rotor.

12. The pump as in claim 11, wherein the inlet and outlet recesses are configured to provide the pump with a dwell angle of zero degrees.

13. The pump as in claim 11, wherein the inlet and outlet recesses are configured to provide the pump with a dwell angle of greater than zero degrees.

14. The pump as in claim 1, wherein the inlet and discharge ports are configured to provide the pump with a dwell angle of zero degrees.

15. The pump as in claim 14, wherein the inlet and outlet recesses are configured to provide the pump with a dwell angle of zero degrees.

16. The pump as in claim 14, wherein the inlet and outlet recesses are configured to provide the pump with a dwell angle of greater than zero degrees.

17. The pump as in claim 1, wherein the casing comprises an inlet recess that is on the inlet side of the pump and is in communication with the inlet port and an outlet recess that is on the outlet side of the pump and is in communication with the outlet port, the inlet and the outlet recesses extending at least partially around one of the driving or driven rotors.

18. The pump as in claim 17, wherein the inlet and outlet recesses are configured to provide the pump with different dwell angles on the inlet side and the outlet side.

19. The pump and in claim 18, wherein the dwell angle on the inlet side of the pump of less than the dwell angle on the discharge side of the pump.

20. The pump as in claim 1, wherein the driving rotor and the driven rotor have different outer diameters.

21. The pump as in claim 1, wherein the driving rotor and the driven rotor have a different number of teeth.

22. The pump as in claim 1, wherein the pump is an internal gear pump and the driving rotor or the driven rotor form an internal gear of the internal gear pump.

23. The pump as in claim 22, wherein internal gear has half as many teeth as an outer gear of the internal gear pump, the outer gear rotating at twice the speed of the inner gear.

24. The pump as in claim 23, wherein the internal gear has a sealing surface with an partially arc seal surface having a center point and a radius dimension and the outer gear has a sealing surface that is a substantially flat surface which is offset from a radial line from the rotational center of the outer gear by the radius dimension of the arc seal surface the internal gear.

25. The pump as in claim 23, wherein the planetary gear pump comprises a planet gear with a fixed rotational axis.

26. The pump as in claim 23, wherein the planetary gear pump comprises a ring gear that is fixed and a plant gear carrier that is free to spin.

27. The pump as in claim 1, wherein the pump is a planetary gear pump and said driven gear forms a planet gear of said planetary gear and acts as both a driving gear and a driven gear.

28. The pump as in claim 1, wherein the teeth of the driving or driven rotors includes a relief between adjacent gear teeth.

29. The pump as in claim 1, wherein the pump includes more than one driving rotor.

30. The pump as in claim 1, wherein the pump includes more than one driven rotor.

31. The pump as in claim 30, wherein the pump includes more than one driving rotor.

32. The pump as in claim 1, wherein each of the driving and driven rotors rotates in a counterclockwise direction.

33. The pump as in claim 1, wherein the driving rotor is completely surrounded by the driven rotor within said pump casing.

34. The pump as in claim 1, wherein the driving rotor and the driven rotor have different numbers of teeth in a ratio of 1 to 2.

35. The pump as in claim 1, wherein the trailing surfaces of the plurality of teeth of the driving rotor and the leading surfaces of the plurality of teeth of the driven rotor are at no time in contact with one another.

* * * * *